US012680784B2

(12) United States Patent
Tivas

(10) Patent No.: US 12,680,784 B2
(45) Date of Patent: Jul. 14, 2026

(54) SIGHT APPARATUS FOR A DEVICE

(71) Applicant: Nicholas Alexander Tivas, San Antonio, TX (US)

(72) Inventor: Nicholas Alexander Tivas, San Antonio, TX (US)

( * ) Notice: Subject to any disclaimer, the term of this patent is extended or adjusted under 35 U.S.C. 154(b) by 3 days.

(21) Appl. No.: 18/906,553

(22) Filed: Oct. 4, 2024

(65) Prior Publication Data

US 2026/0098706 A1 Apr. 9, 2026

(51) Int. Cl.
*F41G 1/30* (2006.01)

(52) U.S. Cl.
CPC ..... *F41G 1/30* (2013.01)

(58) Field of Classification Search
CPC ..... F41G 1/30; F41G 1/32; F41G 1/34; F41G 1/35; F41A 21/02
See application file for complete search history.

(56) References Cited

U.S. PATENT DOCUMENTS 2,385,343 A * 9/1945 Brown ..... F41G 1/345 356/138
10,393,466 B1 * 8/2019 Lavender ..... F41C 27/00
10,557,687 B2 * 2/2020 Teetzel ..... F41G 1/34
11,112,217 B1 9/2021 Neel et al.
11,268,788 B2 * 3/2022 Denk ..... F41G 1/38
11,614,225 B1 * 3/2023 Sabaldan Elpedes ..... F21V 23/0464 362/23.19
2007/0209268 A1 * 9/2007 Birurakis ..... F41G 1/35 42/142
2012/0055063 A1 * 3/2012 Lindau ..... F41G 1/30 42/130
2012/0091347 A1 * 4/2012 Houde-Walter ..... H04N 23/23 250/492.1
2012/0140201 A1 6/2012 Grauslys et al.
2012/0327247 A1 * 12/2012 Mironichev ..... F41G 3/06 235/404
2015/0276352 A1 * 10/2015 Chang ..... F41G 1/35 42/114
2016/0102943 A1 * 4/2016 Teetzel ..... F41G 1/35 42/113
2016/0305741 A1 * 10/2016 Jeung ..... F41G 1/345
2017/0163942 A1 * 6/2017 Teetzel ..... H04N 23/56
2018/0183209 A1 * 6/2018 Nerheim ..... H01S 5/042
2018/0195836 A1 * 7/2018 Matthews ..... F41C 27/00
2018/0292170 A1 * 10/2018 Gagliano ..... F41G 11/003
2019/0120594 A1 * 4/2019 Teetzel ..... F41G 1/345

(Continued)

OTHER PUBLICATIONS

Mepro MOR PRO, retrieved from the internet, retrieved on Oct. 3, 2024, <URL: https://www.meprolight.com/product/mepro-mor-pro/ >.

(Continued)

*Primary Examiner* — Derrick R Morgan

(57) ABSTRACT

The present disclosure provides a sight apparatus for a device. Further, the sight apparatus may include a body comprising a base portion and a sight portion. Further, the sight portion may include a viewing end and a target end. Further, the sight apparatus may include an optical element comprised in the opening and supported by one or more of the sight portion and the base portion. Further, the sight apparatus may include a lighting device comprised in the target end of the sight portion around the opening. Further, the sight apparatus may include a power source comprised in the body.

18 Claims, 20 Drawing Sheets

(56) References Cited

U.S. PATENT DOCUMENTS

| | | | | |
|---|---|---|---|---|
| 2021/0080581 | A1* | 3/2021 | Volfson | G01S 17/95 |
| 2021/0222998 | A1* | 7/2021 | Theisinger | F41G 3/065 |
| 2022/0120533 | A1* | 4/2022 | Teetzel | F41G 3/165 |
| 2023/0176387 | A1* | 6/2023 | Sabaldan Elpedes | H05B 47/11 362/23.19 |
| 2023/0392897 | A1* | 12/2023 | Pischke | F41G 1/35 |
| 2024/0044616 | A1* | 2/2024 | Noskowicz | F41G 1/30 |
| 2024/0085149 | A1* | 3/2024 | Teetzel | F41F 1/00 |
| 2024/0093965 | A1* | 3/2024 | Reese | G02B 23/16 |
| 2025/0044060 | A1* | 2/2025 | Cohen | F41G 1/30 |
| 2025/0085080 | A1* | 3/2025 | Teetzel | F41C 27/00 |
| 2025/0164214 | A1* | 5/2025 | Burayez | F41G 1/30 |
| 2025/0231009 | A1* | 7/2025 | Teetzel | F41G 11/001 |

OTHER PUBLICATIONS

Insight Technology ISM-IR Red Dot Sight w/IR Laser, IR Illuminator, and Visible Laser ISM-1400-A7, retrieved on the internet, retrieved on Oct. 3, 2024; <URL: https://www.opticsplanet.com/insight-technology-ism-ir-red-dot-sight-w-ir-laser-ir-illuminator-and-visible-laser.html>.

Wilcox BOSS Xe Ballistic Optimized Red Dot Reflex Sight w/Visible & IR Laser & Illuminator, retrieved from the internet, retrieved on Oct. 3, 2024; <URL: https://armsunlimited.com/wilcox-boss-xe-ballistic-optimized-red-dot-reflex-sight-w-visible-ir-laser-illuminator/>.

* cited by examiner

SIGHT APPARATUS FOR A DEVICE

FIELD OF THE INVENTION

Generally, the present disclosure relates to the field of illumination. More specifically, the present disclosure relates to a sight apparatus for a device.

BACKGROUND OF THE INVENTION

Currently, there are a number of solutions for using a flashlight with a firearm. Some of these solutions attach various flashlights to the rail under the barrel of a pistol, but these solutions fail to meet the needs of the industry because the light is bulky, harder to conceal and draw, and there are limited types of holsters that may work with that pistol & flashlight combination. Other solutions attempt to make the flashlight as small as possible, but these solutions are similarly unable to meet the needs of the industry because the under-mounted light still blocks the use of many holsters, and the ability to attach a laser sight if desired.

Existing apparatuses for facilitating sighting are deficient with regard to several aspects. In existing apparatuses, the light attached to a firearm is of considerable size and is compatible with limited holsters supporting the firearm and a flashlight combination. As a result, different apparatuses are needed for making a compact flashlight for the firearm and the flashlight combination. In existing apparatuses, the light attached to the firearm cannot be concealed. As a result, different apparatuses are needed to make the light attached to the firearm easier to conceal. In existing apparatuses, the light attached to the firearm hinders the use of different types of holsters. As a result, different apparatuses are needed for the firearm and the flashlight combination to facilitate the use of the different types of holsters.

Therefore, there is a need for an improved sight apparatus for a device that may overcome one or more of the above-mentioned problems and/or limitations.

SUMMARY OF THE INVENTION

This summary is provided to introduce a selection of concepts in a simplified form that are further described below in the Detailed Description. This summary is not intended to identify key features or essential features of the claimed subject matter. Nor is this summary intended to be used to limit the claimed subject matter's scope.

The present disclosure provides a sight apparatus for a device. Further, the sight apparatus may include a body comprising a base portion and a sight portion. Further, the sight portion upwardly extends from the base portion. Further, the sight portion includes a viewing end and a target end. Further, the viewing end opposes the target end. Further, the sight portion defines an opening between the viewing end and the target end. Further, the base portion may be configured for mounting the sight apparatus to one or more devices. Further, the sight apparatus may include one or more optical elements comprised in the opening and supported by one or more of the sight portion and the base portion. Further, the one or more optical elements allow a user to view a target area from the viewing end of the sight portion. Further, the sight apparatus may include one or more lighting devices comprised in the target end of the sight portion around the opening. Further, the one or more lighting devices may be configured for emitting light with one or more characteristics for illuminating the target area. Further, the sight apparatus may include one or more power sources comprised in the body. Further, the one or more power sources may be electrically coupled with the one or more lighting devices. Further, the one or more power sources may be configured for powering the one or more lighting devices. Further, the emitting of the light may be based on the powering.

The present disclosure provides a sight apparatus for a device. Further, the sight apparatus may include a body comprising a base portion and a sight portion. Further, the sight portion upwardly extends from the base portion. Further, the sight portion includes a viewing end and a target end. Further, the viewing end opposes the target end. Further, the sight portion defines an opening between the viewing end and the target end. Further, the base portion may be configured for mounting the sight apparatus to one or more devices. Further, the sight apparatus may include one or more optical elements comprised in the opening and supported by one or more of the sight portion and the base portion. Further, the one or more optical elements allow a user to view a target area from the viewing end of the sight portion. Further, the sight apparatus may include one or more lighting devices comprised in the target end of the sight portion around the opening. Further, the one or more lighting devices may be configured for emitting light with one or more characteristics for illuminating the target area. Further, the one or more lighting devices may include one or more primary lighting devices and one or more secondary lighting devices. Further, the one or more characteristics may include one or more first characteristics and one or more second characteristics. Further, the one or more primary lighting devices may be configured for emitting light of the one or more first characteristics. Further, the one or more secondary lighting devices may be configured for emitting light with the one or more second characteristics. Further, the emitting of the light with the one or more characteristics includes the emitting of the light with the one or more first characteristics and the emitting of the light with the one or more second characteristics. Further, the sight apparatus may include one or more power sources comprised in the body. Further, the one or more power sources may be electrically coupled with the one or more lighting devices. Further, the one or more power sources may be configured for powering the one or more lighting devices. Further, the emitting of the light may be based on the powering.

The present disclosure provides a sight apparatus for a device. Further, the sight apparatus may include a body comprising a base portion and a sight portion. Further, the sight portion upwardly extends from the base portion. Further, the sight portion includes a viewing end and a target end. Further, the viewing end opposes the target end. Further, the sight portion defines an opening between the viewing end and the target end. Further, the base portion may be configured for mounting the sight apparatus to one or more devices. Further, the sight portion includes a first vertical support extending from a first side of the base portion, a second vertical support extending from a second side of the base portion, a horizontal support extending from a first top end of the first vertical support to a second top end of the second vertical support. Further, the first side opposes the second side. Further, the sight apparatus may include one or more optical elements comprised in the opening and supported by one or more of the sight portion and the base portion. Further, the first vertical support, the second vertical support, and the horizontal support extend in at least a part around the one or more optical elements for supporting the one or more optical elements. Further, the one or more optical elements allow a user to view a target area from the viewing end of the sight portion. Further, the sight apparatus may include one or more lighting devices comprised in the target end of the sight portion around the opening. Further, the one or more lighting devices may be configured for emitting light with one or more characteristics for illuminating the target area. Further, the one or more lighting devices may be comprised in the horizontal support of the sight portion. Further, the one or more lighting devices may include a number of lighting devices. Further, the sight apparatus may include one or more power sources comprised in the body. Further, the one or more power sources may be electrically coupled with the one or more lighting devices. Further, the one or more power sources may be configured for powering the one or more lighting devices. Further, the emitting of the light may be based on the powering.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE INVENTION

Figure 1:
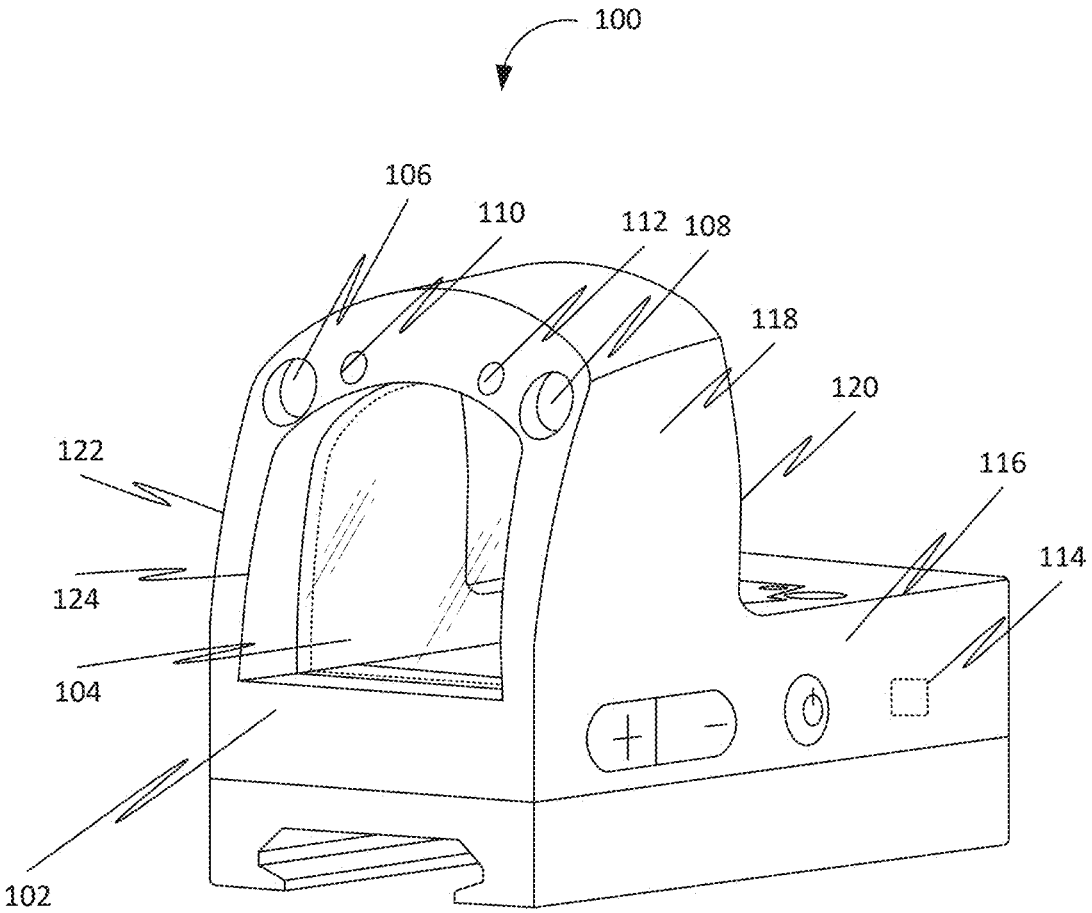
FIG. 1 is a perspective view of a sight apparatus 100 for a device in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure.

Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a sight apparatus for a device, embodiments of the present disclosure are not limited to use only in this context.

In general, the method disclosed herein may be performed by one or more computing devices. For example, in some embodiments, the method may be performed by a server computer in communication with one or more client devices over a communication network such as, for example, the Internet. In some other embodiments, the method may be performed by one or more of at least one server computer, at least one client device, at least one network device, at least one sensor, and at least one actuator. Examples of the one or more client devices and/or the server computer may include, a desktop computer, a laptop computer, a tablet computer, a personal digital assistant, a portable electronic device, a wearable computer, a smartphone, an Internet of Things (IOT) device, a smart electrical appliance, a video game console, a rack server, a super-computer, a mainframe computer, mini-computer, micro-computer, a storage server, an application server (e.g. a mail server, a web server, a real-time communication server, an FTP server, a virtual server, a proxy server, a DNS server, etc.), a quantum computer, and so on. Further, one or more client devices and/or the server computer may be configured for executing a software application such as, for example, but not limited to, an operating system (e.g. Windows, Mac OS, Unix, Linux, Android, etc.) in order to provide a user interface (e.g. GUI, touch-screen based interface, voice based interface, gesture based interface, etc.) for use by the one or more users and/or a network interface for communicating with other devices over a communication network. Accordingly, the server computer may include a processing device configured for performing data processing tasks such as, for example, but not limited to, analyzing, identifying, determining, generating, transforming, calculating, computing, compressing, decompressing, encrypting, decrypting, scrambling, splitting, merging, interpolating, extrapolating, redacting, anonymizing, encoding and decoding. Further, the server computer may include a communication device configured for communicating with one or more external devices. The one or more external devices may include, for example, but are not limited to, a client device, a third party database, a public database, a private database, and so on. Further, the communication device may be configured for communicating with the one or more external devices over one or more communication channels. Further, the one or more communication channels may include a wireless communication channel and/or a wired communication channel. Accordingly, the communication device may be configured for performing one or more of transmitting and receiving of information in electronic form. Further, the server computer may include a storage device configured for performing data storage and/or data retrieval operations. In general, the storage device may be configured for providing reliable storage of digital information. Accordingly, in some embodiments, the storage device may be based on technologies such as, but not limited to, data compression, data backup, data redundancy, deduplication, error correction, data fingerprinting, role based access control, and so on.

Further, one or more steps of the method disclosed herein may be initiated, maintained, controlled, and/or terminated based on a control input received from one or more devices operated by one or more users such as, for example, but not limited to, an end user, an admin, a service provider, a service consumer, an agent, a broker and a representative thereof. Further, the user as defined herein may refer to a human, an animal, or an artificially intelligent being in any state of existence, unless stated otherwise, elsewhere in the present disclosure. Further, in some embodiments, the one or more users may be required to successfully perform authentication in order for the control input to be effective. In general, a user of the one or more users may perform authentication based on the possession of a secret human readable data (e.g. username, password, passphrase, PIN, secret question, secret answer, etc.) and/or possession of a machine readable secret data (e.g. encryption key, decryption key, bar codes, etc.) and/or possession of one or more embodied characteristics unique to the user (e.g. biometric variables such as, but not limited to, fingerprint, palm-print, voice characteristics, behavioral characteristics, facial features, iris pattern, heart rate variability, evoked potentials, brain waves, and so on) and/or possession of a unique device (e.g. a device with a unique physical and/or chemical and/or biological characteristic, a hardware device with a unique serial number, a network device with a unique IP/MAC address, a telephone with a unique phone number, a smartcard with an authentication token stored thereupon, etc.). Accordingly, the one or more steps of the method may include communicating (e.g. transmitting and/or receiving) with one or more sensor devices and/or one or more actuators in order to perform authentication. For example, the one or more steps may include receiving, using the communication device, the secret human readable data from an input device such as, for example, a keyboard, a keypad, a touch-screen, a microphone, a camera, and so on. Likewise, the one or more steps may include receiving, using the communication device, the one or more embodied characteristics from one or more biometric sensors.

Further, one or more steps of the method may be automatically initiated, maintained, and/or terminated based on one or more predefined conditions. In an instance, the one or more predefined conditions may be based on one or more contextual variables. In general, the one or more contextual variables may represent a condition relevant to the performance of the one or more steps of the method. The one or more contextual variables may include, for example, but are not limited to, location, time, identity of a user associated with a device (e.g. the server computer, a client device, etc.) corresponding to the performance of the one or more steps, environmental variables (e.g. temperature, humidity, pressure, wind speed, lighting, sound, etc.) associated with a device corresponding to the performance of the one or more steps, physical state and/or physiological state and/or psychological state of the user, physical state (e.g. motion, direction of motion, orientation, speed, velocity, acceleration, trajectory, etc.) of the device corresponding to the performance of the one or more steps and/or semantic content of data associated with the one or more users. Accordingly, the one or more steps may include communicating with one or more sensors and/or one or more actuators associated with the one or more contextual variables. For example, the one or more sensors may include, but are not limited to, a timing device (e.g. a real-time clock), a location sensor (e.g. a GPS receiver, a GLONASS receiver, an indoor location sensor etc.), a biometric sensor (e.g. a fingerprint sensor), an environmental variable sensor (e.g. temperature sensor, humidity sensor, pressure sensor, etc.) and a device state sensor (e.g. a power sensor, a voltage/current sensor, a switch-state sensor, a usage sensor, etc. associated with the device corresponding to performance of the or more steps).

Further, the one or more steps of the method may be performed one or more number of times. Additionally, the one or more steps may be performed in any order other than as exemplarily disclosed herein, unless explicitly stated otherwise, elsewhere in the present disclosure. Further, two or more steps of the one or more steps may, in some embodiments, be simultaneously performed, at least in part. Further, in some embodiments, there may be one or more time gaps between performance of any two steps of the one or more steps.

Further, in some embodiments, the one or more predefined conditions may be specified by the one or more users. Accordingly, the one or more steps may include receiving, using the communication device, the one or more predefined conditions from one or more devices operated by the one or more users. Further, the one or more predefined conditions may be stored in the storage device. Alternatively, and/or additionally, in some embodiments, the one or more predefined conditions may be automatically determined, using the processing device, based on historical data corresponding to performance of the one or more steps. For example, the historical data may be collected, using the storage device, from a plurality of instances of performance of the method. Such historical data may include performance actions (e.g. initiating, maintaining, interrupting, terminating, etc.) of the one or more steps and/or the one or more contextual variables associated therewith. Further, machine learning may be performed on the historical data in order to determine the one or more predefined conditions. For instance, machine learning on the historical data may determine a correlation between one or more contextual variables and performance of the one or more steps of the method. Accordingly, the one or more predefined conditions may be generated, using the processing device, based on the correlation.

Overview:

The present disclosure describes a sight apparatus for a device.

Further, the present disclosure describes an apparatus related to reflex sight device and method of illumination. Further, the apparatus may include the sight apparatus.

Further, the apparatus comprises a red dot sight which allows for faster target acquisition. Furthermore, the apparatus comprises a device that allows a shooter to see the target in dark or dim areas. Further, the apparatus comprises a compact tactical flashlight that may be used with any holster. Therefore, there currently exists a need in the industry for a compact red dot sight that may be used with a low-profile flashlight. Similarly, the apparatus has an associated method that allows the low-profile flashlight to be integrated with the red dot sight as one unit, which is mounted on top of the firearm, leaving the other mounting positions open for other accessories or use with standard holsters.

Further, the apparatus is a reflex sight with an integrated flashlight, which is made up of the following components: a metal or plastic housing, one plastic or glass lens, a 3 or 6-volt battery, multiple LEDs of varying size, color, & wavelength, multiple on/off switches, up/down & left/right adjustment screws, two mounting screws, and a small wiring. These components are connected as follows: The housing comprises all other components. The lens is oriented vertically near the front of the housing. The 1-4 LEDs are mounted above or to the sides of the lens. The LEDs are wired to on/off switches that may be on any or all sides of the housing. The switches are wired to the battery which is inside the lower center or the housing. The red dot LED is centered low near the back of the housing, wired to the battery, and an on/off/brightness switch. The adjustment screws move the red dot LED, and are near the back of the housing, with the up/down screw oriented vertically through the top surface, and the left/right screw oriented horizontally through either side of the housing.

Further, the device may also have one or more of the following: metal or plastic housing, plastic or glass lens, 3 or 6-volt battery, one or more LEDs of varying size, color, and wavelength including infrared, one or more switches on any or all sides of the housing, connection for a remote pressure switch, separate controls for reticle LED and flashlight LEDs, brightness variation controls for the reticle and/or the flashlight LEDs, solar power source, detachable flashlight LED pods, and light sources other than LEDs.

Further, the disclosed device is unique when compared with other known devices and solutions because the disclosed device provides a tactical flashlight built into a reflex sight, an infrared flashlight built into a reflex sight, and the flashlights utilize the power source of the reflex sight, allowing for the most compact and versatile designs.

Further, the disclosed device is unique in that the disclosed device is structurally different from other known devices or solutions. More specifically, the device is unique due to the presence of bright white and infrared LED flashlights, a thicker housing top above the lens to hold the LEDs, two CR2032 batteries stacked to form a 6-volt power source, and the use of multiple types of switches (push-button on/off, sliding on/off, push-button brightness adjustments) to control different features on the reflex sight.

Further, the present disclosure is directed to a reflex sight device and a method of illumination. Further, the reflex sight device is made up of the following components: a rectangular metal housing with a glass lens, two 5 mm bright white 6 volt LEDs, two 3 mm IR 1.5 volt LEDs, one 3 mm red 3 volt LED, two CR2032 3 volt batteries, two voltage resistors, one push-button on/off switch, one push-button on/off & brightness switch, one sliding on/off switch, two adjustment screws, and some small wiring.

Further, these components are connected as follows: The lens is oriented vertically near the front of the housing. The lens has a coating on the lens to reduce glare and allow the red dot reticle to be projected on the lens. Above the lens, both corners of the housing each have one 5 mm bright white LED and one 3 mm IR LED. The 5 mm 6v LEDs are wired in a series to the push-button on/off switch and the batteries. The 3 mm 1.5v LEDs are wired in a separate series, to a voltage resistor, a sliding on/off switch, and the batteries. The 3 mm 3v red LED is wired to a resistor, a push-button on/off & brightness switch, and the batteries. The batteries are stacked to form a 6v series and located inside the lower center of the housing. The red LED is mounted inside the back center of the housing, projecting onto the inside of the lens, with one adjustment screw above for up/down, and one adjustment screw on the right side of the housing for left/right. Furthermore, a small PCB board may be mounted inside of the housing, to control various brightness and reticle settings.

Further, two 5 mm visible light LEDs and two 3 mm infrared LEDs are integrated with the housing above the lens. The wiring for the LEDs is encased in the housing on both sides of the lens. The wiring continues into the base of the housing, where the wiring is connected to switches, resistors, and the power source. One or more batteries are located inside the base of the housing.

Further, there is a "+/−" brightness switch which also turns the reticle on or off, with the "+" towards the front of the housing. There is a push-button on/off switch for the visible light LEDs.

Further, the left/right reticle adjustment screw is at the back of the housing. Also, there is a push-button on/off switch for the infrared LEDs. Alternatively, a sliding on/off switch may be used for the infrared LEDs.

FIG. 1 is a perspective view of a sight apparatus 100 for a device in accordance with some embodiments. Accordingly, the sight apparatus 100 may include a body 102, at least one optical element 104, at least one lighting device 106-112, and at least one power source 114. Further, the sight apparatus 100 may include a reflex sight, a reflex sight device, etc.

Further, the body 102 may include a base portion 116 and a sight portion 118. Further, the sight portion 118 upwardly extends from the base portion 116. Further, the sight portion 118 may include a viewing end 120 and a target end 122. Further, the viewing end 120 opposes the target end 122. Further, the sight portion 118 defines an opening 124 between the viewing end 120 and the target end 122. Further, the base portion 116 may be configured for mounting the sight apparatus 100 to at least one device (1202 and 1302). Further, the target end 122 may be directed towards a front end of the at least one device (1202 and 1302) and the viewing end 120 may be directed towards a rear end of the at least one device (1202 and 1302). Further, the body 102 may be comprised of at least one material. Further, the at least one material may include plastic, metal, etc. Further, the body 102 may be a housing. Further, the body 102 may be formed from a single piece of material. Further, the sight portion 118 defines a line of sight through the opening 124 parallel to said an axis of the at least one device (1202 and 1302).

Further, the at least one optical element 104 may be comprised in the opening 124 and supported by at least one of the sight portion 118 and the base portion 116. Further, the opening 124 extends from the viewing end 120 to the target end 122. Further, the opening 124 may be cylindrically shaped. Further, the at least one optical element 104 allows a user to view a target area from the viewing end 120 of the sight portion 118. Further, the at least one optical element 104 may include a first surface directed towards the target end 122, and a second surface directed towards the viewing end 120. Further, the first surface opposes the second surface. Further, the at least one optical element 104 intersects the line of sight.

Further, the at least one lighting device 106-112 may be comprised in the target end 122 of the sight portion 118 around the opening 124. Further, the at least one lighting device 106-112 may be configured for emitting light with at least one characteristic for illuminating the target area. Further, the at least one characteristic may include one or more wavelengths of the light, one or more frequencies of the light, one or more intensities of the light, a polarization of the light, a coherency of the light, a chromaticity of the light, a directionality of the light, etc.

Further, the at least one power source 114 may be comprised in the body 102. Further, the at least one power source 114 may be electrically coupled with the at least one lighting device 106-112. Further, the at least one power source 114 may be configured for powering the at least one lighting device 106-112. Further, the emitting of the light may be based on the powering. Further, the at least one power source 114 may include a battery.

In some embodiments, the body 102 may include a metal housing. Further, the body 102 may include a plastic housing. Further, the at least one device (1202 and 1302) may include a camera. Further, the at least one device (1202 and 1302) may include a firearm. Further, the at least one device (1202 and 1302) may include a gun. Further, the at least one device (1202 and 1302) may include a pistol, a carbine, etc. Further, the at least one device (1202 and 1302) may include a rifle. Further, the at least one device (1202 and 1302) may include a shotgun. Further, the at least one device (1202 and 1302) may include an airsoft gun. Further, the target end 122 may include an end of the body 102 facing the target area. Further, the viewing end 120 may include an end of the body 102 facing an eye of a user. Further, the at least one optical element 104 may include at least one lens, at least one screen, at least one transparent element, at least one magnifying optical element, at least one non magnifying optical element, etc. Further, the at least one lighting device 106-112 may include a light-emitting diode (LED) device. Further, the at least one power source 114 may include an energy storage device. Further, the at least one power source 114 may include a battery. Further, the battery may be non-chargeable. Further, the at least one power source 114 has a voltage of 6 volt. Further, the at least one power source 114 may include a plurality of CR2032 batteries. Further, the target area may include a portion of a surrounding of the sight apparatus 100 viewed through the sight apparatus 100.

Further, in some embodiments, the at least one lighting device 106-112 may include at least one primary lighting device 106-108 and at least one secondary lighting device 110-112. Further, the at least one characteristic may include at least one first characteristic and at least one second characteristic. Further, the at least one primary lighting device may be configured for emitting light of the at least one first characteristic. Further, the at least one secondary lighting device may be configured for emitting light with the at least one second characteristic. Further, the emitting of the light with the at least one characteristic may include the emitting of the light with the at least one first characteristic and the emitting of the light with the at least one second characteristic. Further, the at least one first characteristic of the light may include a first wavelength of the light, a first frequency of the light, a first polarity of the light, a first intensity of the light, a first polarization of the light, a first coherency of the light, a first chromaticity of the light, a first directionality of the light, etc. Further, the at least one second characteristic of the light may include a second wavelength of the light, a second frequency of the light, a second polarity of the light, a second intensity of the light, a second polarization of the light, a second coherency of the light, a second chromaticity of the light, a second directionality of the light, etc. Further, the first wavelength and the first frequency may be associated with a visible portion of the electromagnetic spectrum. Further, the second wavelength and the second frequency may be associated with an infrared portion of the electromagnetic spectrum. Further, the second wavelength and the second frequency may be associated with an ultraviolet portion of the electromagnetic spectrum. Further, the at least one first characteristic of the light may be different from the at least one second characteristic of the light.

In some embodiments, the at least one primary lighting device 106-108 may include a visible LED. Further, the at least one secondary lighting device 110-112 may include an infrared LED, an ultraviolet LED, etc. Further, the at least one secondary lighting device 110-112 may be used for night vision. Further, the at least one characteristic may include a frequency of light. Further, the at least one secondary lighting device 110-112 may include a 3 mm infrared LED light, a 3 mm ultraviolet LED light, etc. Further, the at least one primary lighting device 106-108 may include a 5 mm white LED.

Further, in an embodiment, the at least one first characteristic may include a first wavelength of the light emitted by the at least one primary lighting device. Further, the at least one second characteristic may include a second wavelength of the light emitting by the at least one secondary lighting device. Further, the first wavelength of the light may be within a visible portion of electromagnetic radiation. Further, the second wavelength may be within an infrared portion of the electromagnetic radiation. Further, the second wavelength may be within an ultraviolet portion of the electromagnetic spectrum.

Further, in some embodiments, the base portion 116 of the body 102 may be configured to be dismountably mounted from the at least one device (1202 and 1302).

Figure 2:
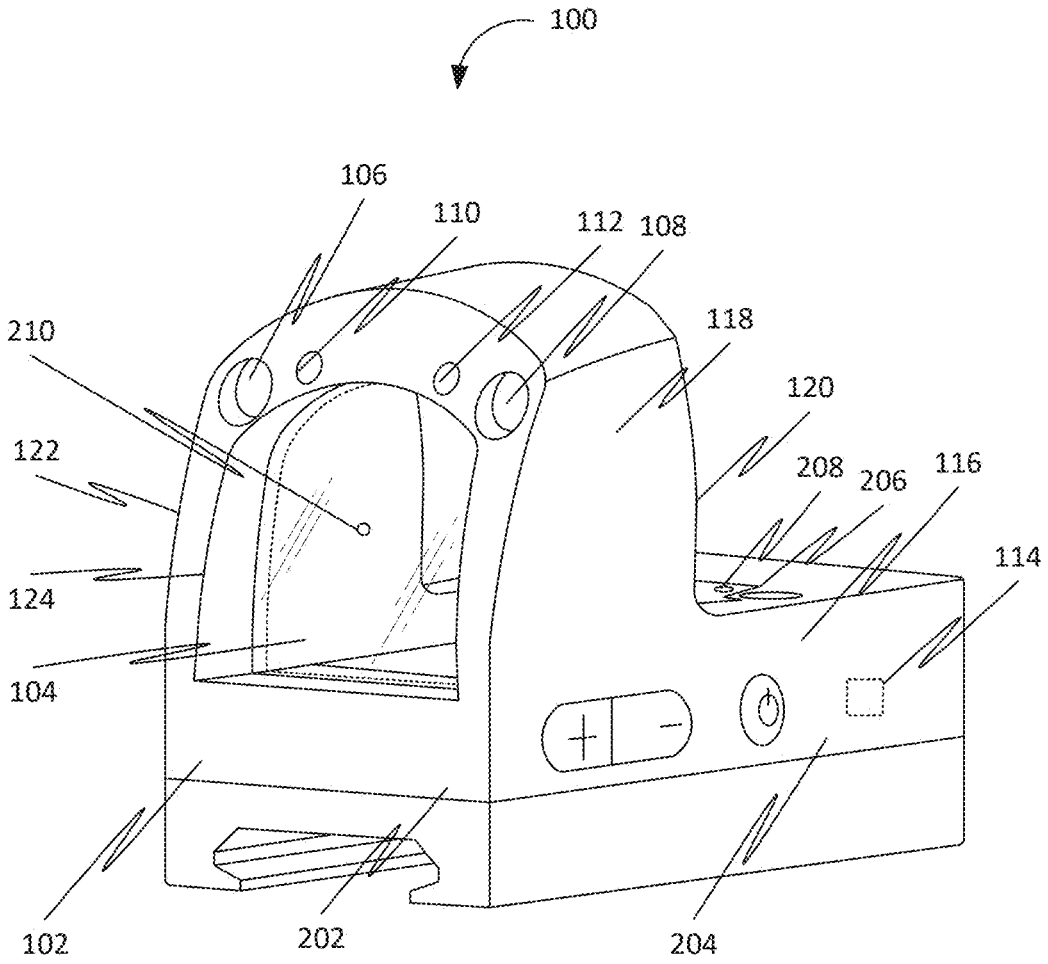
FIG. 2 is a front perspective view of the sight apparatus 100, in accordance with some embodiments.

Further, in some embodiments, the base portion 116 of the body 102 may include a front base portion 202 and a rear base portion 204, as shown in FIG. 2. Further, the sight portion 118 extends from the front base portion 202. Further, the rear base portion 204 may include a receptacle 206 comprised in a center of the rear base portion 204. Further, the sight apparatus 100 may include an additional lighting device comprised in the receptacle 206 of the rear base portion 204. Further, the additional lighting device 208 may be configured for projecting a reticle 210 onto the at least one optical element 104. Further, the additional lighting device 208 may be configured for aiming in the target area. Further, the at least one power source 114 may be electrically coupled with the additional lighting device 208. Further, the at least one power source 114 may be configured for powering the additional lighting device 208. Further, the projecting of the additional lighting device 208 may be based on the powering.

In some embodiments, the reticle 210 may include a dot of visible light of any frequency. Further, the reticle 210 may include a red dot. Further, the additional lighting device 208 may include a laser device. Further, the additional lighting device 208 may include a light-emitting diode, a laser diode, etc.

Figure 3:
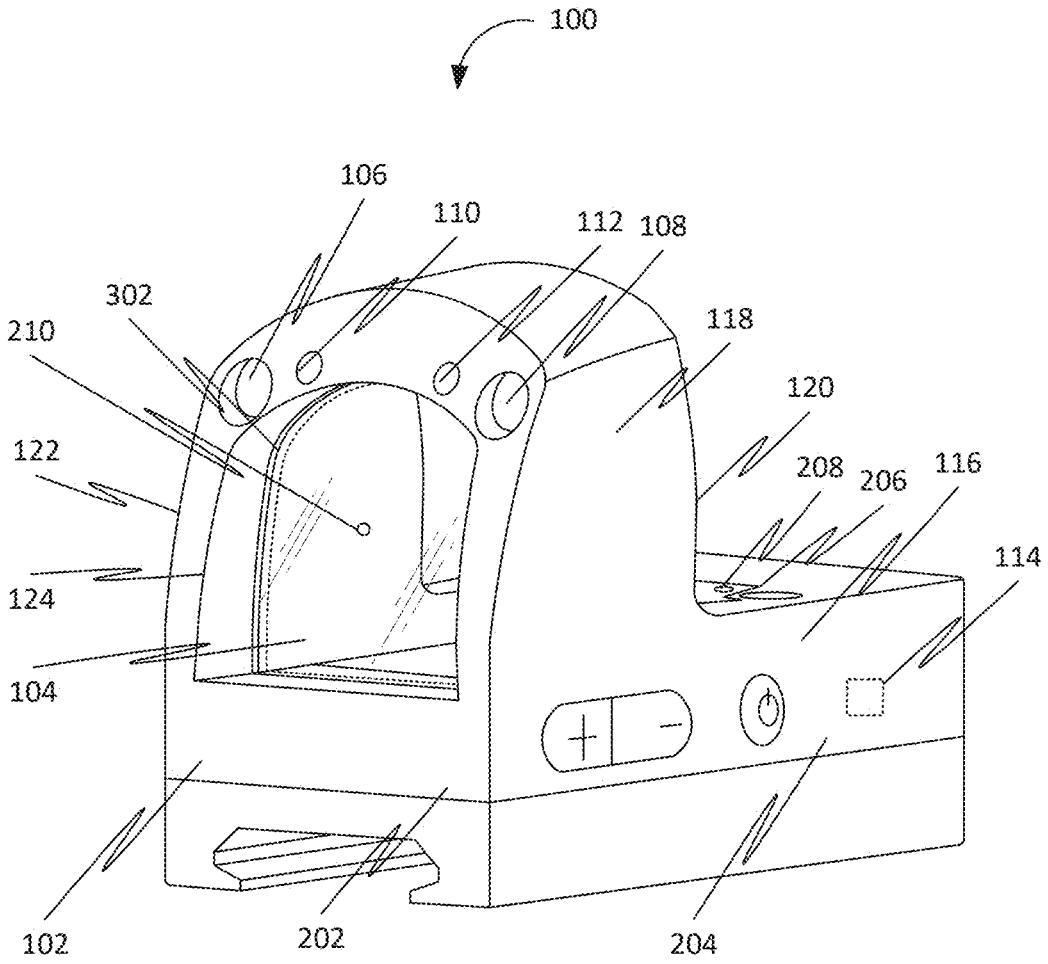
FIG. 3 is a front perspective view of the sight apparatus 100, in accordance with some embodiments.

Further, in an embodiment, the at least one optical element 104 may include at least one layer 302, as shown in FIG. 3, of at least one material on at least one surface of the at least one optical element 104. Further, the at least one material may include a glare reducing material, a light polarizing material, a light intensity varying material, etc. Further, the glare reducing material may include magnesium fluoride, polyethylene terephthalate, photochromic material, etc. Further, the at least one layer 302 of the at least one material allows the projecting of the reticle 210 on the at least one optical element 104. Further, the at least one surface may include a viewing surface of the at least one optical element 104. Further, the at least one material may include phosphor dyes and/or fluorescent dyes, such as europium, manganese, cadmium sulfide, etc. Further, the at least one material allows converting ultraviolet light to visible light.

In some embodiments, the at least one layer 302 may include a coating on the at least one optical element 104. Further, the at least one material may include an anti-reflecting material. Further, the at least one layer 302 reduces glare onto the at least one optical element 104 from the additional lighting device 208. Further, the at least one layer 302 reduces glare onto the at least one optical element 104 from the at least one lighting device 106-112.

Further, in some embodiments, the sight portion 118 may include a first vertical support 402 extending from a first side 404 of the base portion 116, a second vertical support 406 extending from a second side 408 of the base portion 116, a horizontal support 410 extending from a first top end 412 of the first vertical support 402 to a second top end 414 of the second vertical support 406. Further, the first side 404 opposes the second side 408. Further, the first vertical support 402, the second vertical support 406, and the horizontal support 410 extend in at least a part around the at least one optical element 104 for supporting the at least one optical element 104.

Further, in an embodiment, the at least one lighting device 106-112 may be comprised in the horizontal support 410 of the sight portion 118. Further, in an embodiment, the at least one lighting device 106-112 may include at least one primary lighting device 106-108 and at least one secondary lighting device 110-112. Further, the at least one lighting device 106-112 may include a plurality of pair of lighting devices. Further, the plurality of pair of lighting devices includes a first pair of lighting devices and a second pair of lighting devices. Further, the first pair of lighting devices may include a first primary lighting device 106 and a first secondary lighting device 110. Further, the second pair of lighting devices may include a second primary lighting device 108 and a second secondary lighting device 112. Further, the first pair of lighting devices and the second pair of lighting devices may be spacedly comprised in the horizontal support 410. Further, the first pair of lighting devices may be comprised in a first end portion of the horizontal support 410 and the second pair of lighting devices may be comprised in a second end portion of the horizontal support 410. Further, the first end portion opposes the second end portion. Further, an arrangement of the first primary lighting device 106 and the first secondary lighting device 110 in the first pair of lighting devices may be an opposite of an arrangement of the second primary lighting device 108 and the second secondary lighting device 112 in the second pair of lighting devices.

Further, in some embodiments, the at least one lighting device 106-112 may include a number of lighting devices. Further, the number of lighting devices ranges from 1 to 4.

Further, in some embodiments, the at least one characteristic of the light may include an intensity of the light. Further, the sight apparatus 100 may include at least one first input device 502 electrically coupled with the at least one lighting device 106-112 and the at least one power source 114. Further, the at least one lighting device 106-112 may be electrically coupled with the at least one power source 114 through the at least one first input device 502 Further, the at least one first input device 502 may be configured for receiving at least one input. Further, the at least one input may include an input action received on the at least one first input device 502. Further, the input action may include a pressing action, a pushing action, a sliding action, a rotating action, a turning action, etc. Further, the at least one first input device 502 may be configured to be transitioned between a plurality of states based on the at least one input. Further, the intensity of the light emitted by the at least one lighting device 106-112 transitions between a plurality of levels of the intensity of the light based on the transitioning of the at least one first input device 502 between the plurality of states.

In some embodiments, the at least one first input device 502 may include a remote pressure switch. Further, the at least one first input device 502 may include at least one button. Further, the at least one button may include a first button and a second button. Further, the first button may include a "+" button configured for increasing a brightness corresponding to the intensity of the at least one primary lighting device 106-108. Further, the second button may include a "–" button configured for decreasing the brightness of the at least one primary lighting device 106-108.

In further embodiments, the sight apparatus 100 may include at least one second input device (602 and 806) electrically coupled with the at least one lighting device 106-112 and the at least one power source 114. Further, the at least one lighting device 106-112 may be electrically coupled with the at least one power source 114 through the at least one second input device (602 and 806) Further, the at least one second input device (602 and 806) may be configured for receiving at least one second input. Further, the at least one second input may include an input action received on the at least one second input device (602 and 806).

Further, the input action may include a pressing action, a pushing action, a sliding action, a rotating action, a turning action, etc. Further, the at least one second input device (602 and 806) may be configured to be transitioned between at least one first state and at least one second state based on the at least one second input. Further, the transitioning of the at least one second input device (602 and 806) transitions the at least one lighting device 106-112 between an on state and an off state. Further, the emitting of the light with the at least one characteristic may be based on the on state of the at least one lighting device 106-112. Further, the at least one lighting device 106-112 does not emit light in the off state of the at least one lighting device 106-112.

In some embodiments, the at least one second input device (602 and 806) may be an on/off switch. Further, the switch affixed to the base portion 116 may include a rotary switch. Further, the rotary switch may be associated with an activation of the at least one secondary lighting device. 110-112. Further, the at least one second input device (602 and 806) may include a remote pressure switch. Further, the at least one second input device (602 and 806) may include a sliding switch. Further, the sliding switch may be associated with an infrared lighting device.

In further embodiments, the sight apparatus 100 may include at least one first sensor 702, a processing device 704, and a lighting control device 706. Further, the at least one first sensor 702, the processing device 704, and the lighting control device 706 may be comprised in the body 102. Further, the at least one first sensor 702 may be configured for detecting at least one environmental condition of an environment associated with the sight apparatus 100. Further, the processing device 704 may be communicatively coupled with the at least one first sensor 702. Further, the processing device 704 may be configured for generating at least one environmental data based on the detecting of the at least one environmental condition. Further, the processing device 704 may be configured for analyzing the at least one environmental data. Further, the processing device 704 may be configured for determining at least one required characteristic of the light required to be emitted by the at least one lighting device 106-112. Further, the processing device 704 may be configured for generating at least one command based on the determining of the at least one required characteristic of the light. Further, the lighting control device 706 may be communicatively coupled with the processing device 704. Further, the at least one lighting device 106-112 may be electrically coupled to the at least one power source 114 through the lighting control device 706. Further, the lighting control device 706 may be configured for configuring the at least one lighting device 106-112. Further, the emitting of the light with the at least one characteristic comprises emitting of the light with the at least one required light characteristic based on the configuring. Further, the at least one required characteristic of the light may include a required wavelength of the light, a required frequency of the light, a required polarity of the light, a required intensity of the light, a required polarization of the light, a required coherency of the light, a required chromaticity of the light, a required directionality of the light, etc.

In some embodiments, the at least one first sensor 702 may include an environment sensor (such as an ambient light sensor, a visibility sensor, a precipitation sensor, a humidity sensor, a temperature sensor, etc). Further, the at least one first sensor 702 may include a proximity sensor. Further, the at least one environmental condition may include an intensity level of ambient light, a visibility in the environment, a fog present in the environment, etc. Further, the at least one environmental condition may include a measurement of a distance between the target area and the body 102. Further, the lighting control device 706 may include a controller, a PCB board, a current controller, a voltage controller, a power controller, etc. Further, the configuring of the at least one lighting device 106-112 may include determining at least one value for at least one operating parameter for the at least one lighting device 106-112. Further, the at least one operating parameter may include an intensity, a wavelength, a color, a polarity, a beam angle, a beam shape, an activation timing, etc. Further, the at least one lighting device 106-112 may include a spectral light source, a LED array, a smart LED lighting device, a multi spectral lighting device, etc.

Further, in an embodiment, the at least one lighting device 106-112 may include a plurality of lighting devices. Further, the processing device 704 may be configured for selecting the at least one lighting device 106-112 from the plurality of lighting devices based on the analyzing of the at least one environmental data. Further, the processing device 704 may be configured for generating at least one first command for the at least one lighting device 106-112 based on the determining of the selection of the at least one lighting device 106-112. Further, the lighting control device 706 may be configured for activating the at least one lighting device 106-112 based on the at least one first command. Further, the emitting of the light with the at least one required characteristic by the at least one lighting device 106-112 may be based on the activating of the at least one lighting device 106-112.

In further embodiments, the sight apparatus 100 may include at least one adjustment mechanism 802-804 comprised in the body 102. Further, the at least one adjustment mechanism 802-804 may be configured for adjusting at least one alignment of the sight apparatus 100 in relation to the at least one device (1202 and 1302) based on at least one adjustment input receivable by the at least one adjustment mechanism 802-804. Further, the at least one adjustment input may include an adjustment action. Further, the adjustment action may include a pushing action, a twisting action, a turning action, a pressing action, etc.

In some embodiments, the at least one adjustment mechanism 802-804 may include a adjustment screw. Further, the screw may include a first screw and a second screw. Further, the first screw may be oriented vertically through a top surface of the base portion 116 and the second screw may be oriented horizontally through either side of the housing. Further, the first screw may be configured for modifying at least one of a position and an orientation of the additional lighting device 208 for moving the reticle 210 projected on the at least one optical element 104 either upwards or downwards on the at least one optical element 104. Further, the second screw may be configured for modifying at least one of the position and the orientation of the additional lighting device 208 for moving the reticle 210 projected on the at least one optical element moving the reticle 210 either left or right on the at least one optical element 104. Further, the screw may include a set screw. Further, the screw may be located in the rear base portion. 204.

Further, in some embodiments, the sight portion 118 may include at least one mechanism 902 comprised in the sight portion 118. Further, the at least one mechanism 902 may be coupled with the at least one lighting device 106-112. Further, the at least one mechanism 902 may be configured for configured for modifying at least one of a position and an orientation of the at least one lighting device 106-112 in relation to the target end 122 of the sight portion 118.

In some embodiments, the at least one mechanism 902 may include a linear movement mechanism, a rotary movement mechanism, etc. Further, the rotatory movement mechanism may include a gimbal mechanism. Further, the linear movement mechanism may include a lead screw mechanism.

In an embodiment, the sight apparatus 100 may include at least one second sensor 1002, a processing device 1004, and at least one actuator 1006. Further, the at least one second sensor 1002, the processing device 1004, and the at least one actuator 1006 may be comprised in the body 102. Further, the at least one second sensor 1002 may be configured for detecting the at least one environmental condition of an environment associated with the sight apparatus 100. Further, the processing device 1004 may be communicatively coupled with the at least one second sensor 1002. Further, the processing device 1004 may be configured for generating at least one environmental data based on the detecting of the at least one environmental condition. Further, the processing device 1004 may be configured for analyzing the at least one environmental data. Further, the processing device 1004 may be configured for determining a required illumination field for the sight apparatus 100 based on the analyzing of the at least one environmental data. Further, the processing device 1004 may be configured for determining at least one of a required position and a required orientation of the at least one lighting device 106-112 based on the determining of the required illumination field. Further, the processing device 1004 may be configured for generating at least one second command for the emitting of the light by the at least one lighting device 106-112 with the required illumination field. Further, the at least one actuator 1006 may be communicatively coupled with the processing device 1004 Further, the at least one actuator 1006 may be operatively coupled with the at least one mechanism 902. Further, the at least one actuator 1006 may be configured for transitioning the at least one mechanism 902 to at least one state based on the at least one second command. Further, the transitioning of the at least one mechanism 902 to the at least one state modifies at least one of the position and the orientation of the at least one lighting device 106-112 to at least one of the required position and the orientation. Further, the at least one actuator 1006 may include a motor (such as a servo motor, stepper motor, etc.).

In some embodiments, the at least one second sensor may include a proximity sensor, an environment sensor (a visibility sensor, a precipitation sensor, an ambient light sensor, a pressure sensor, a humidity sensor, etc), etc. Further, the determining of the required illumination field may be associated with a proximity of the target area. Further, the required illumination field may be inversely proportional to the proximity of the target area.

Further, in some embodiments, the base portion 116 may include at least one mounting element 1102 comprised in the base portion 116. Further, the at least one mounting element 1102 may be configured to be engaged with at least one portion of the at least one device (1202 and 1302). Further, the mounting of the sight apparatus 100 to the at least one device (1202 and 1302) may be based on the engaging of the at least one mounting element 1102 to the at least one portion of the at least one device (1202 and 1302). Further, the at least one mounting element 1102 may include at least one of a channel, a cavity, and a receptacle comprising at least one feature (such as projections, grooves, etc.) for securely receiving at least one portion of the at least one device (1202 and 1302).

In some embodiments, the at least one mounting element 1102 may include at least one screw. Further, the at least one portion may include a gun turret. Further, the engaging of the at least one mounting element 1102 to the at least one portion of the at least one device (1202 and 1302) may cause an initiation of activation of the additional lighting device 208.

Further, in some embodiments, the at least one device (1202 and 1302) may include a firearm. Further, the mounting of the sight apparatus 100 to the at least one device (1202 and 1302) may include mounting the sight apparatus 100 to the firearm.

FIG. 2 is a front perspective view of the sight apparatus 100, in accordance with some embodiments.

FIG. 3 is a front perspective view of the sight apparatus 100, in accordance with some embodiments.

Figure 4:
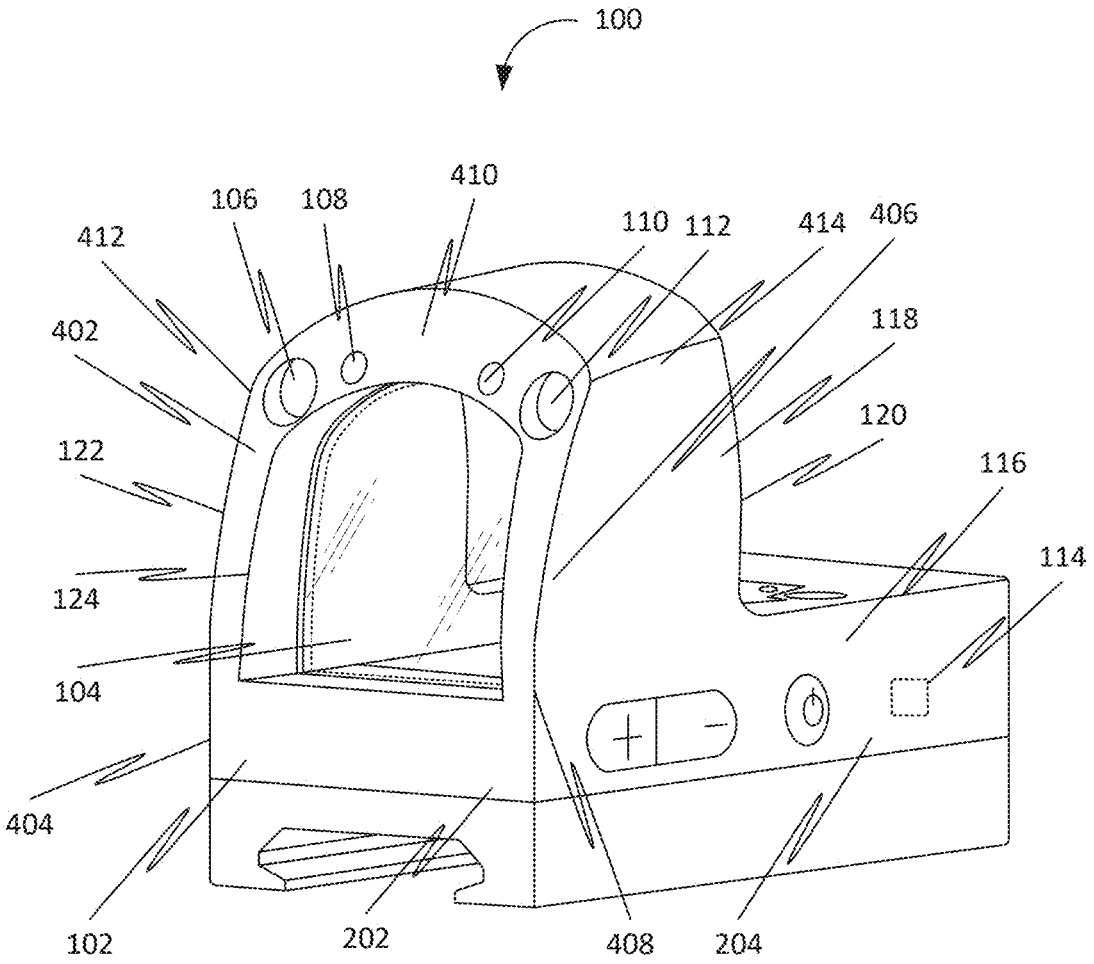
FIG. 4 is a front perspective view of the sight apparatus 100, in accordance with some embodiments.

FIG. 4 is a front perspective view of the sight apparatus 100, in accordance with some embodiments.

Figure 5:
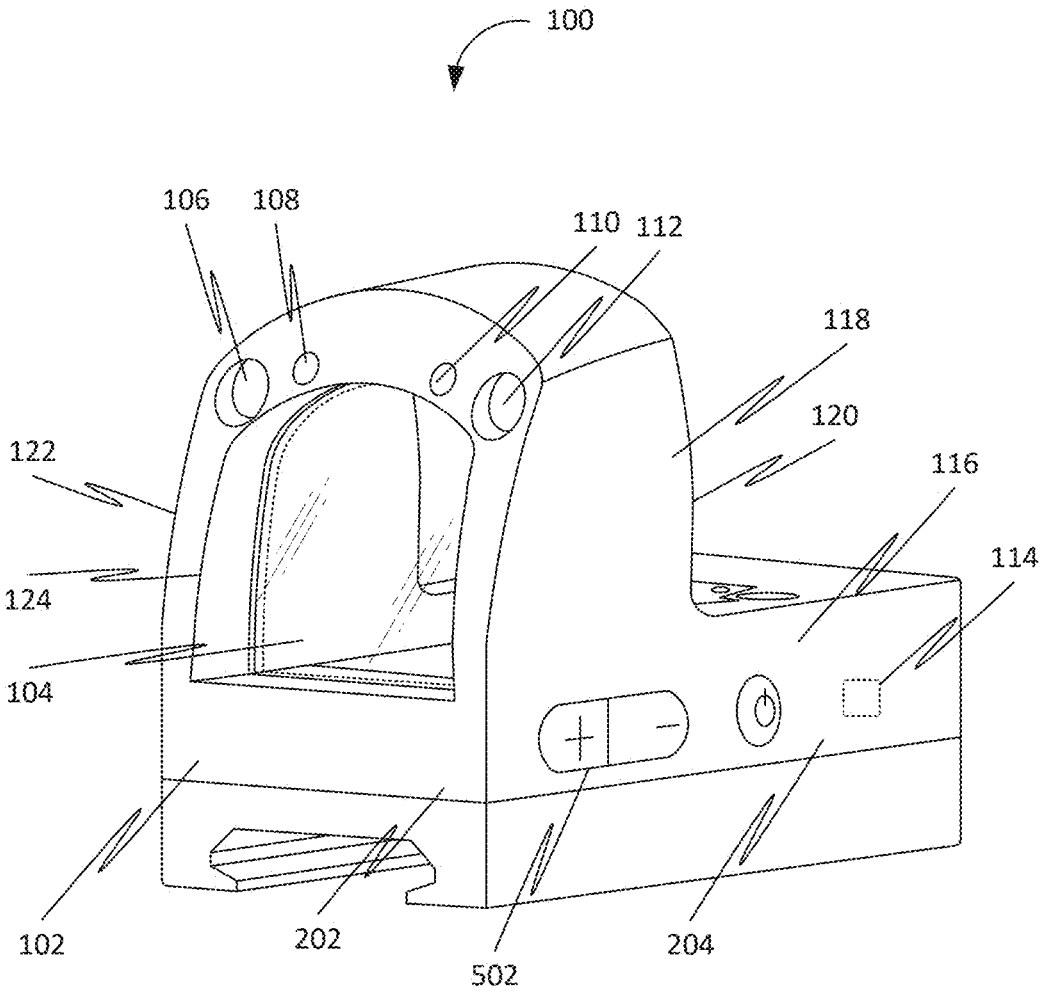
FIG. 5 is a front perspective view of the sight apparatus 100, in accordance with some embodiments.

FIG. 5 is a front perspective view of the sight apparatus 100, in accordance with some embodiments.

Figure 6:
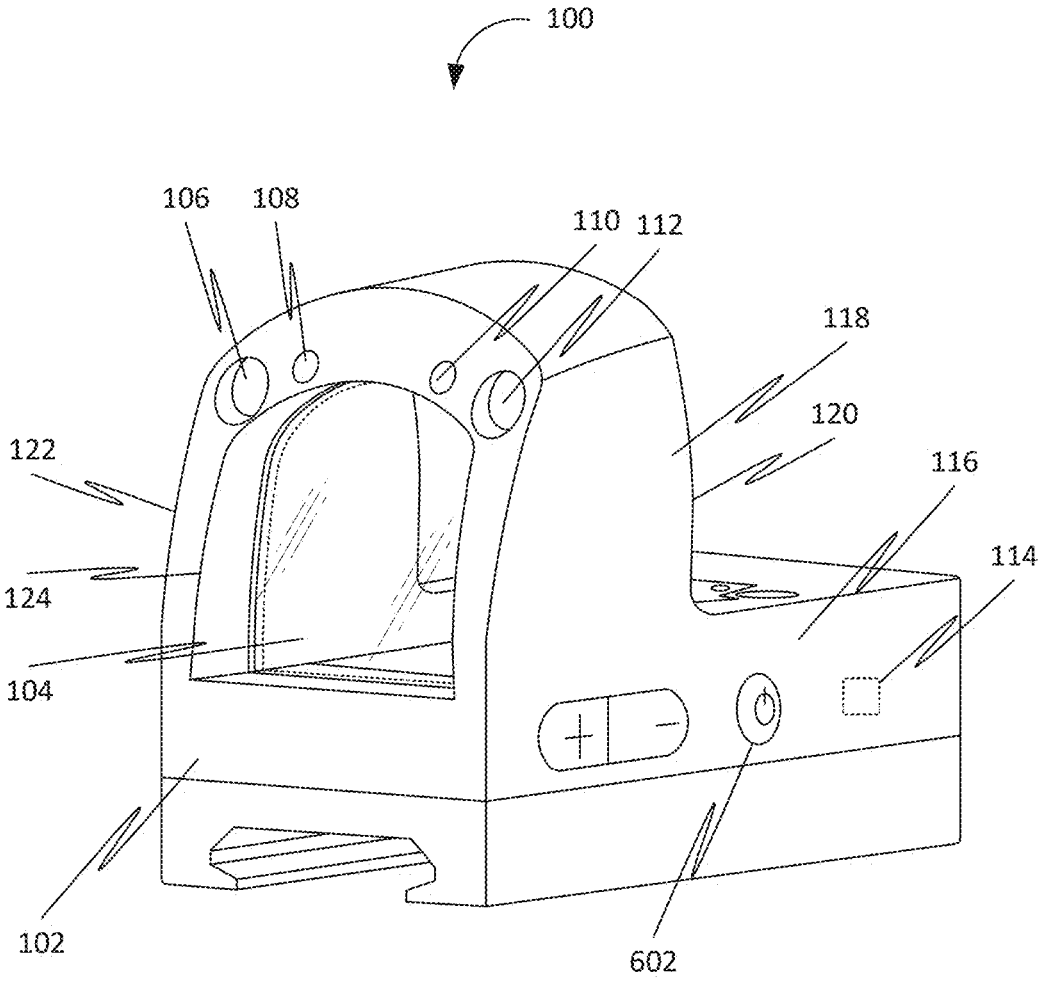
FIG. 6 is a front perspective view of the sight apparatus 100, in accordance with some embodiments.

FIG. 6 is a front perspective view of the sight apparatus 100, in accordance with some embodiments.

Figure 7:
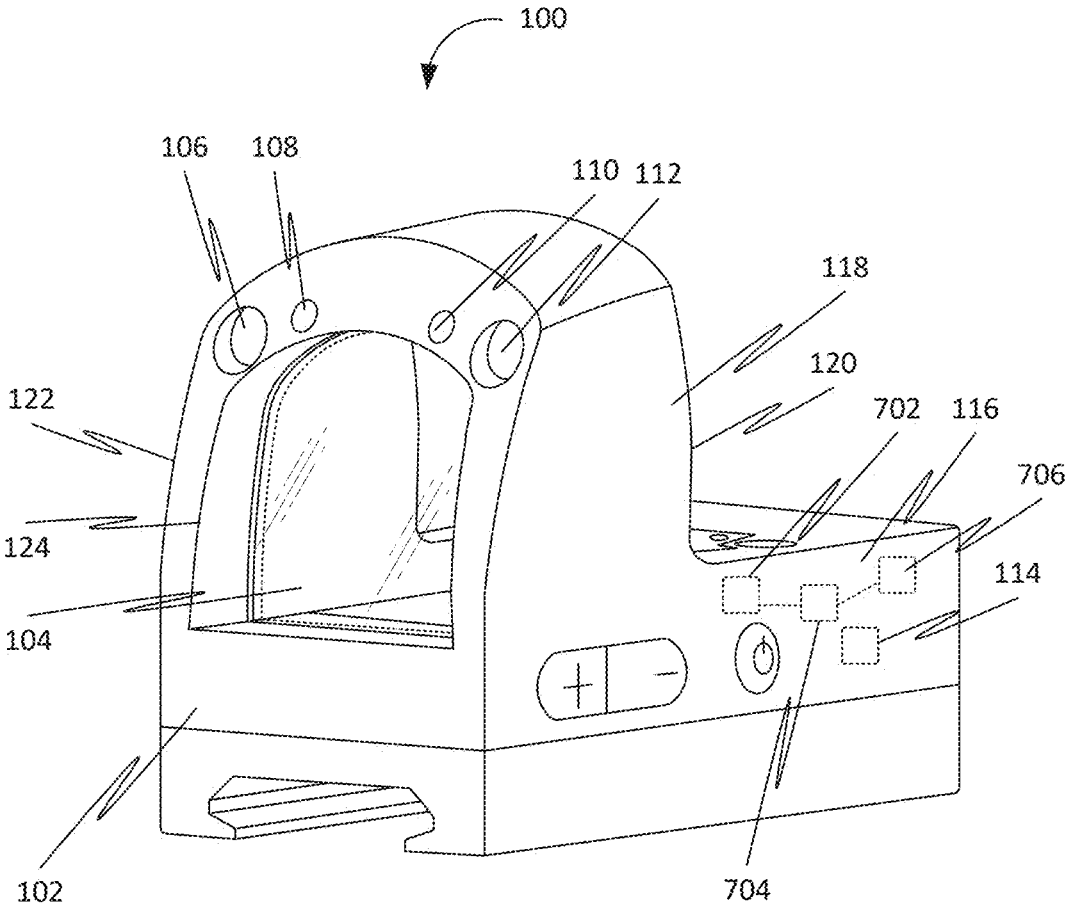
FIG. 7 is a front perspective view of the sight apparatus 100, in accordance with some embodiments.

FIG. 7 is a front perspective view of the sight apparatus 100, in accordance with some embodiments.

Figure 8:
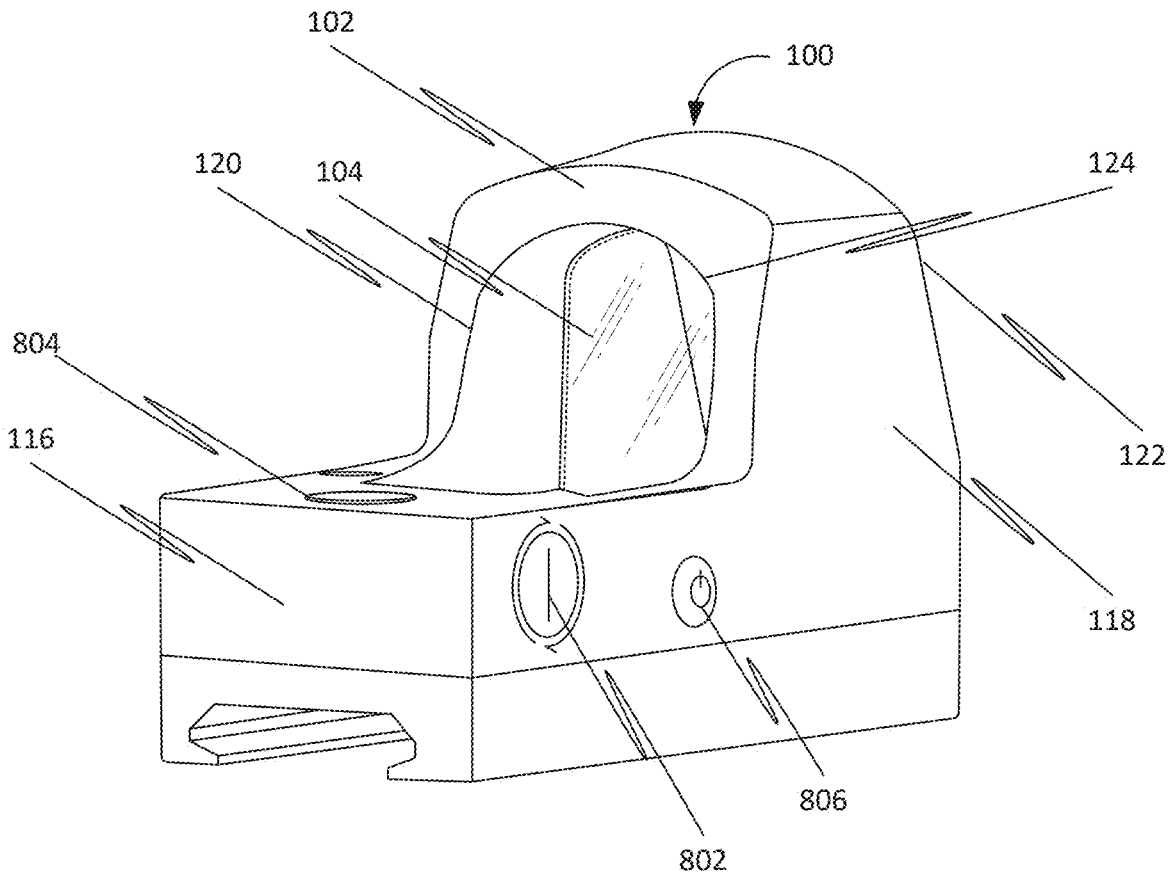
FIG. 8 is a rear perspective view of the sight apparatus 100, in accordance with some embodiments.

FIG. 8 is a rear perspective view of the sight apparatus 100, in accordance with some embodiments.

Figure 9:
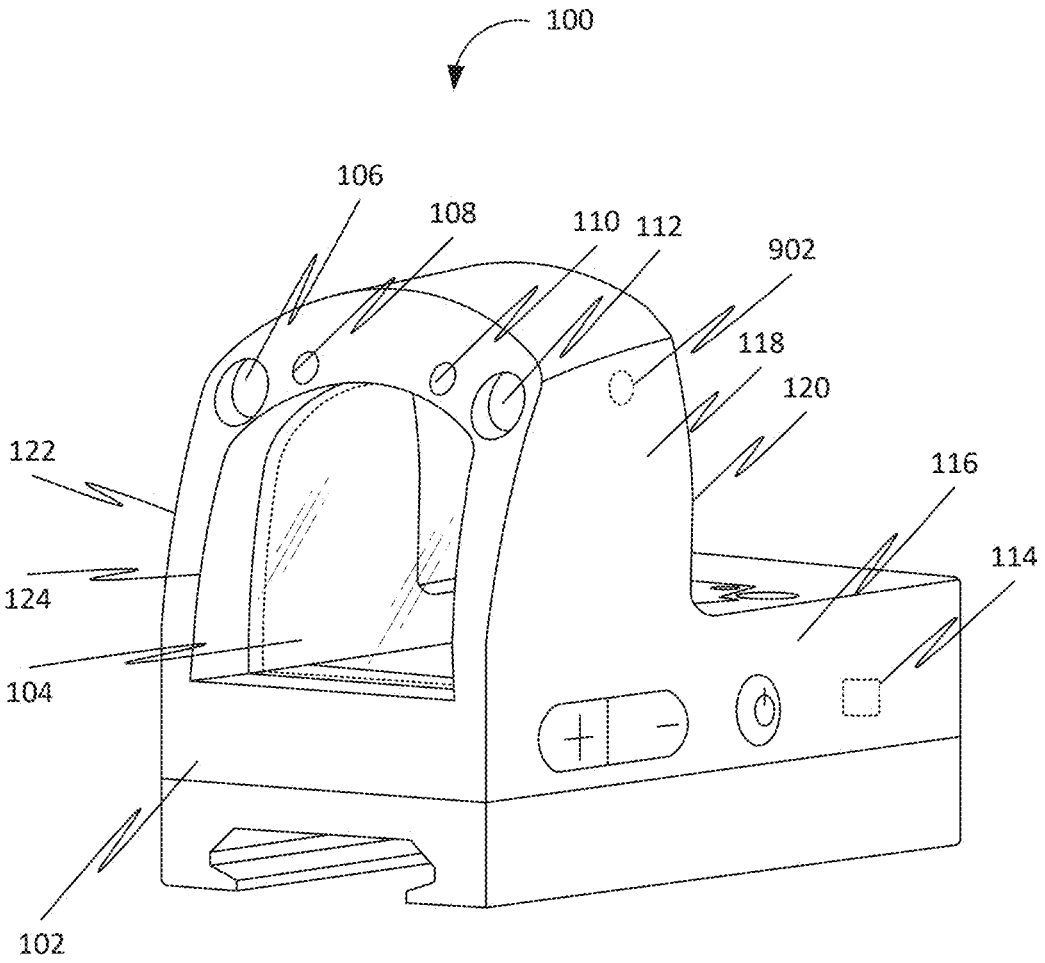
FIG. 9 is a front perspective view of the sight apparatus 100, in accordance with some embodiments.

FIG. 9 is a front perspective view of the sight apparatus 100, in accordance with some embodiments.

Figure 10:
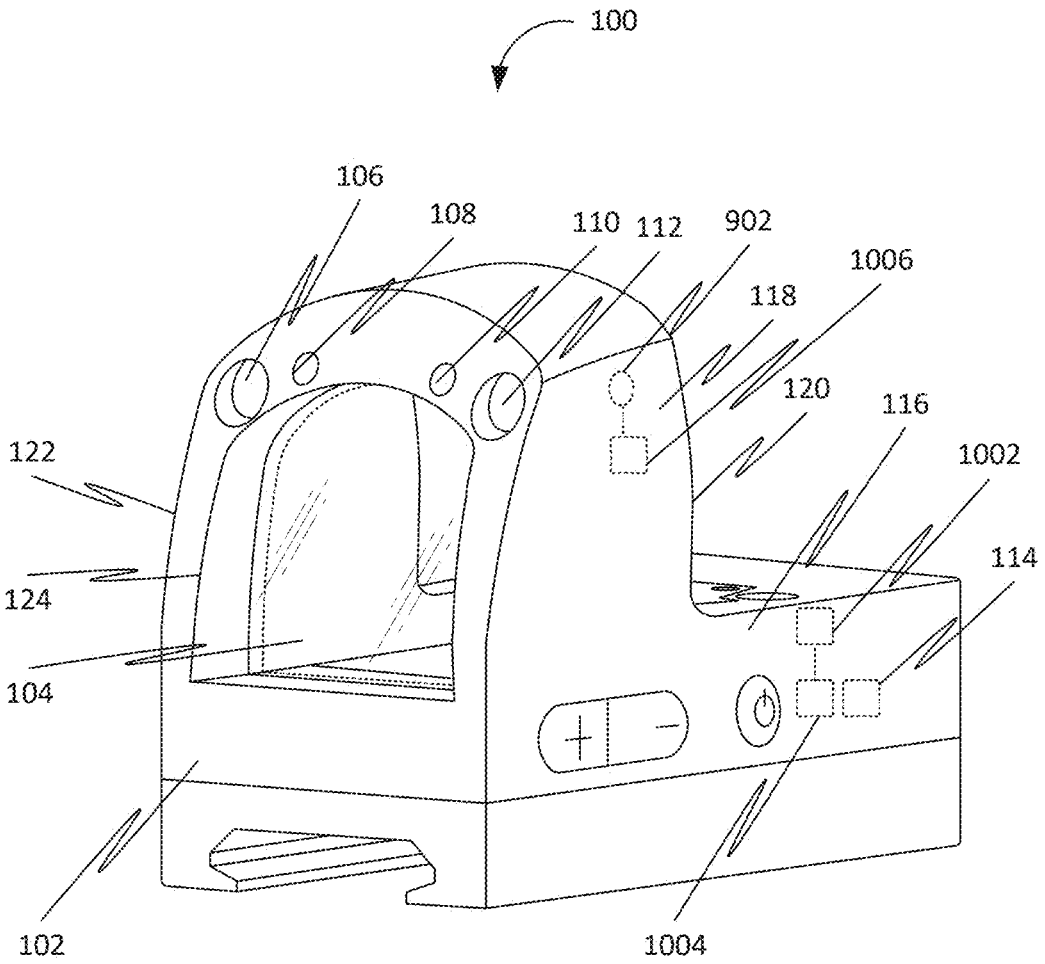
FIG. 10 is a front perspective view of the sight apparatus 100, in accordance with some embodiments.

FIG. 10 is a front perspective view of the sight apparatus 100, in accordance with some embodiments.

Figure 11:
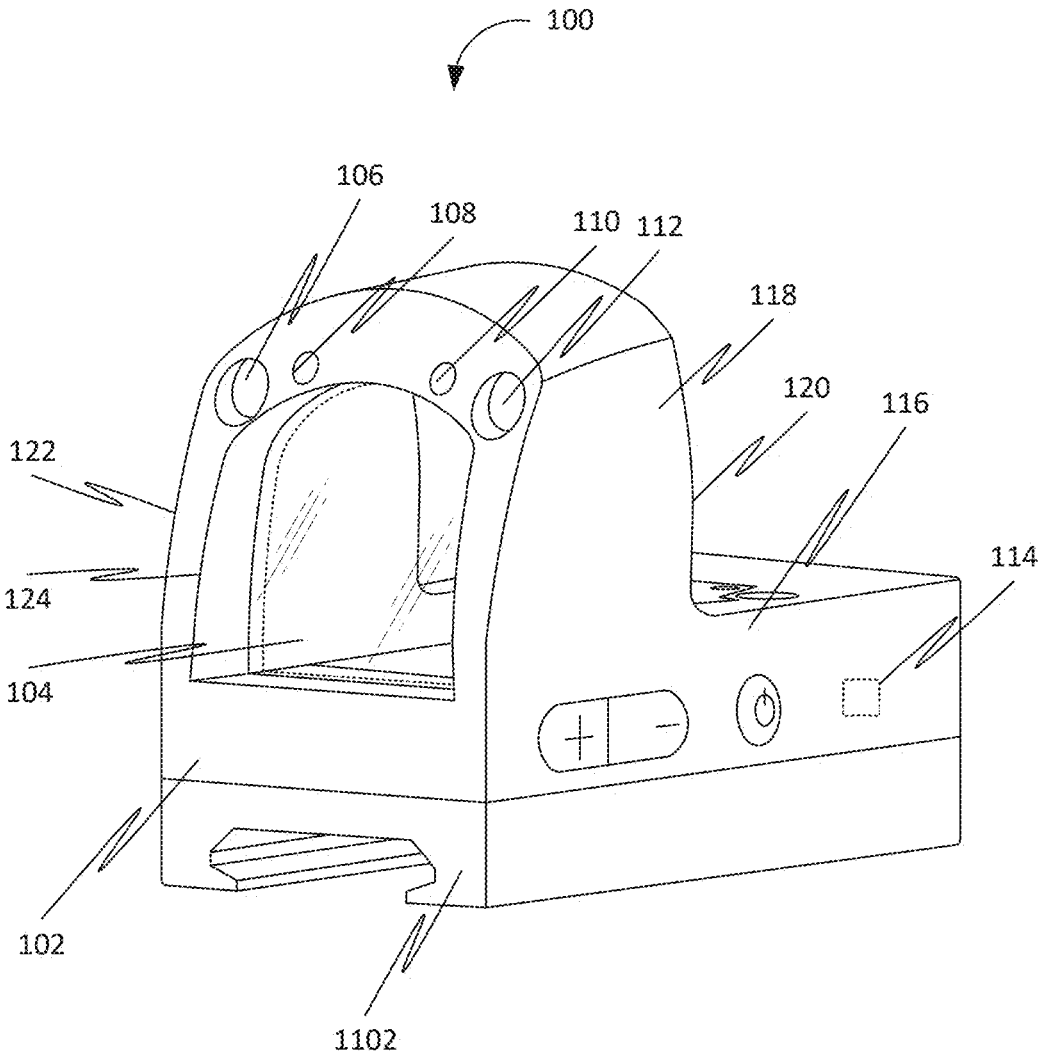
FIG. 11 is a front perspective view of the sight apparatus 100, in accordance with some embodiments.

FIG. 11 is a front perspective view of the sight apparatus 100, in accordance with some embodiments.

Figure 12:
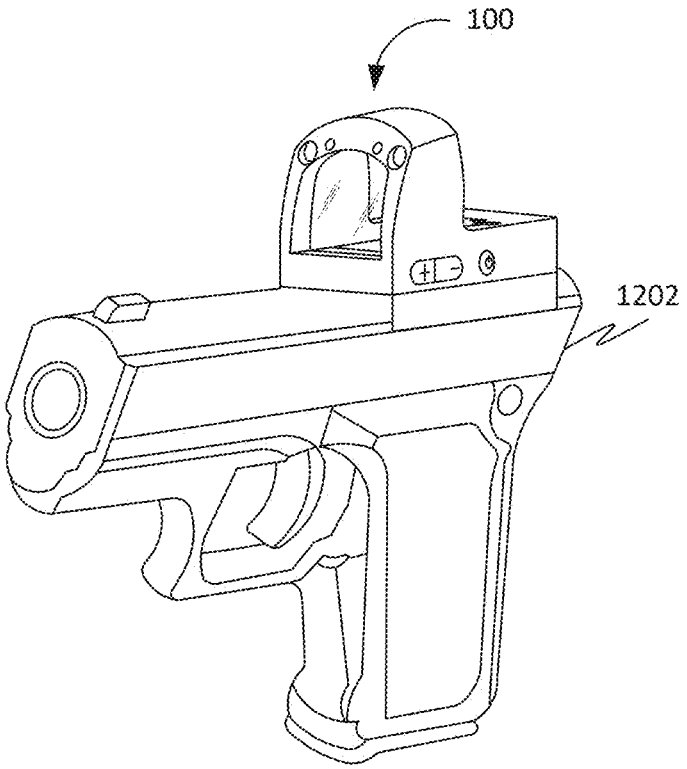
FIG. 12 is a front perspective view of the sight apparatus 100 with a first device 1202 of the at least one device (1202 and 1302), in accordance with some embodiments.

FIG. 12 is a front perspective view of the sight apparatus 100 with a first device 1202 of the at least one device (1202 and 1302), in accordance with some embodiments.

Figure 13:
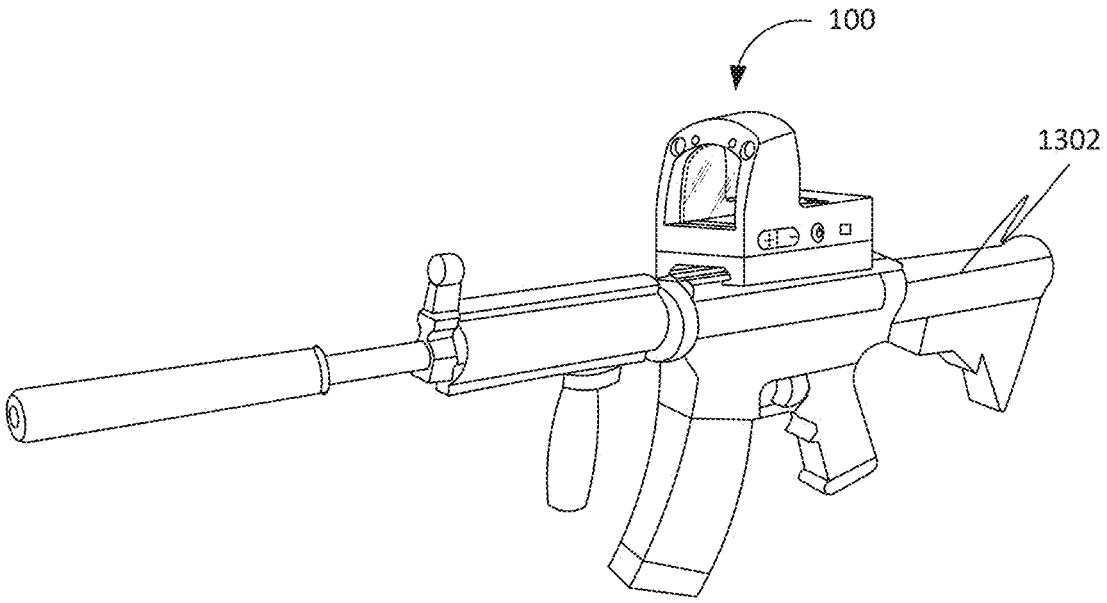
FIG. 13 is a front perspective view of the sight apparatus 100 with a second device 1302 of the at least one device (1202 and 1302), in accordance with some embodiments.

FIG. 13 is a front perspective view of the sight apparatus 100 with a second device 1302 of the at least one device (1202 and 1302), in accordance with some embodiments.

Figure 14:
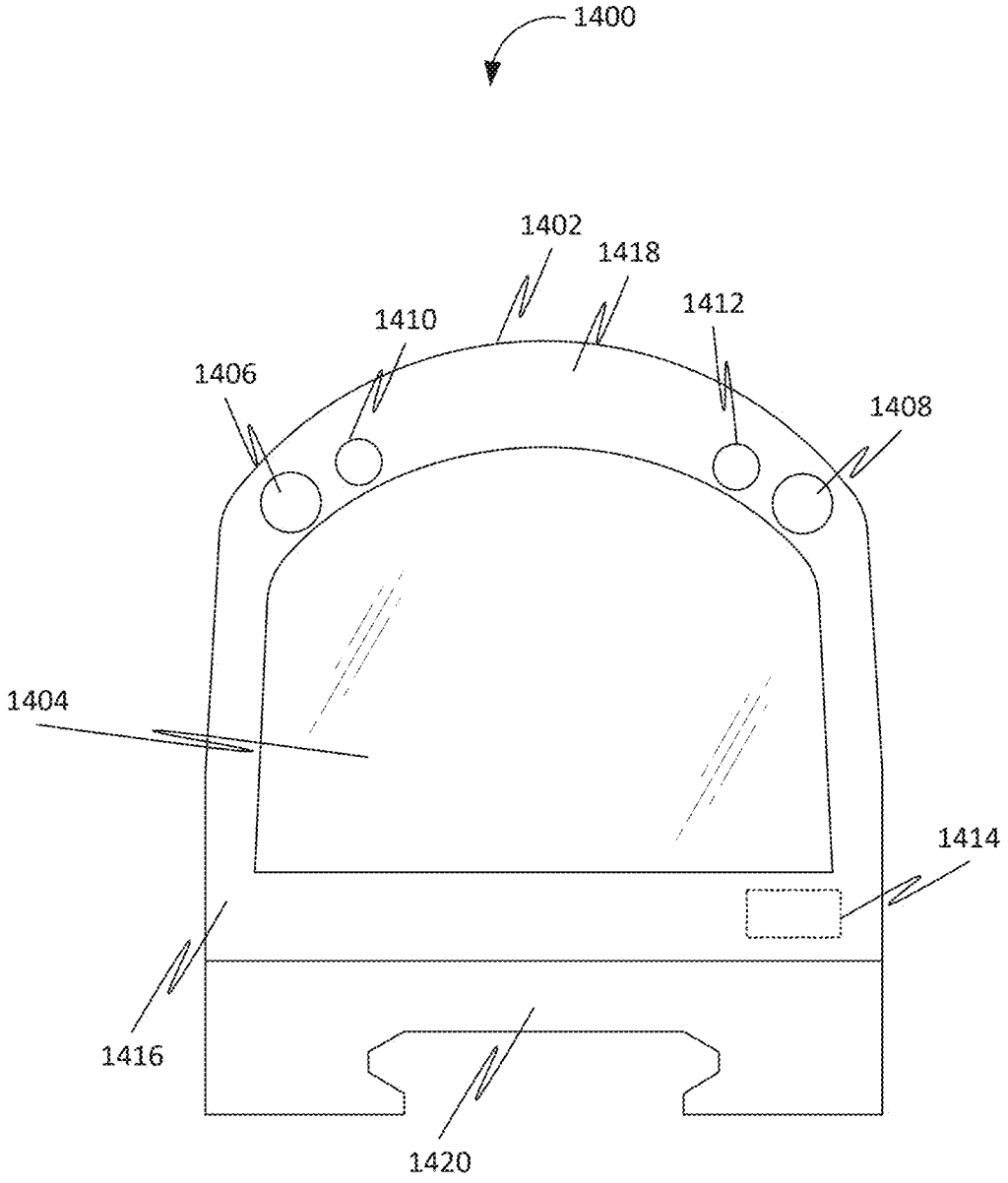
FIG. 14 is a front view of a sight apparatus 1400 for facilitating sighting, in accordance with some embodiments.

FIG. 14 is a front view of a sight apparatus 1400 for facilitating sighting, in accordance with some embodiments. Further, the sight apparatus 1400 may include a body 1402, at least one optical element 1404, at least one lighting device 1406-1412, and at least one power source 1414. Further, the body 1402 may include a base portion 1416 and a sight portion 1418. Further, the base portion 1416 may include at least one mounting element 1420 comprised in the base portion 1416.

Figure 15:
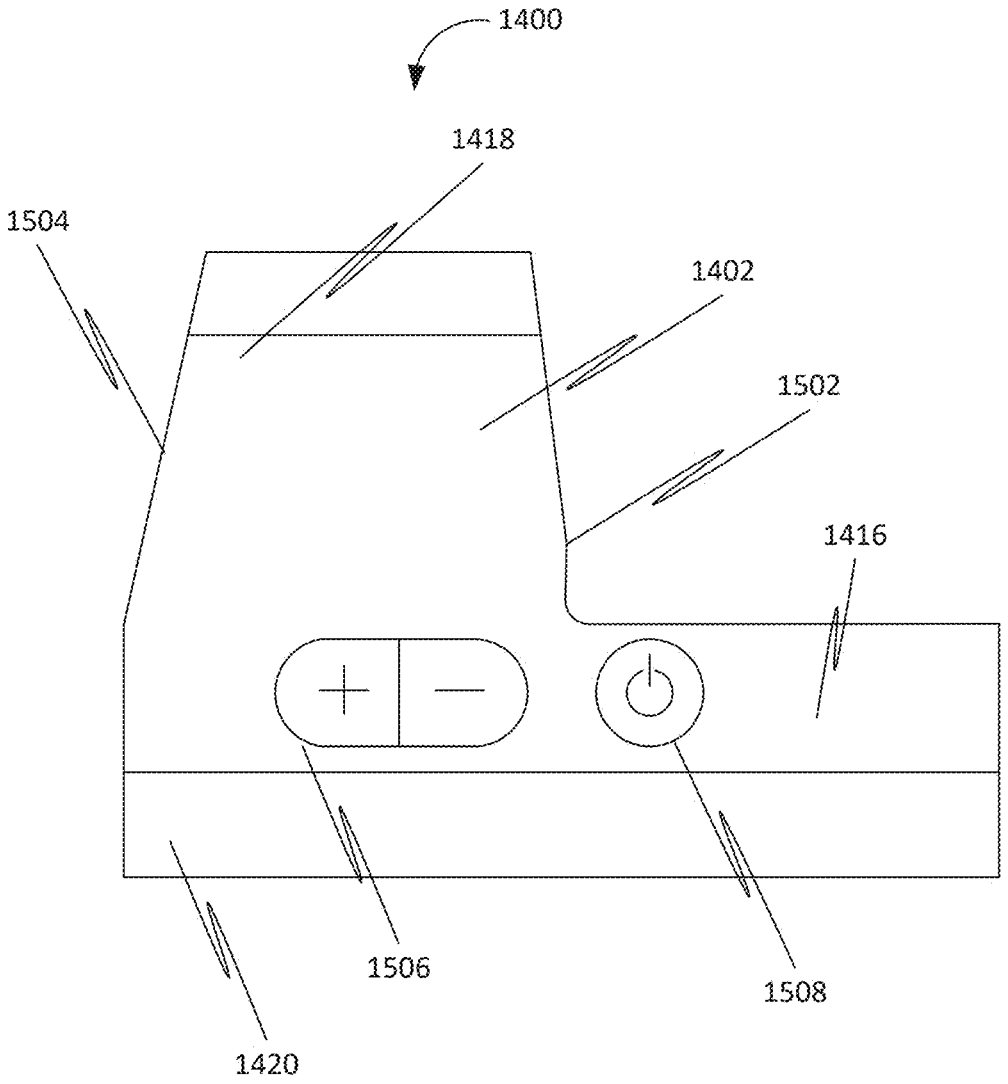
FIG. 15 is a right view of the sight apparatus 1400 for facilitating sighting, in accordance with some embodiments.

FIG. 15 is a right view of the sight apparatus 1400 for facilitating sighting, in accordance with some embodiments. Further, the sight portion 1418 may include a viewing end 1502 and a target end 1504. Further, the sight apparatus 1400 may include a brightness button 1506 and an on/off button 1508. Further, the base portion 1416 may include at least one mounting element 1420 comprised in the base portion 1416.

Figure 16:
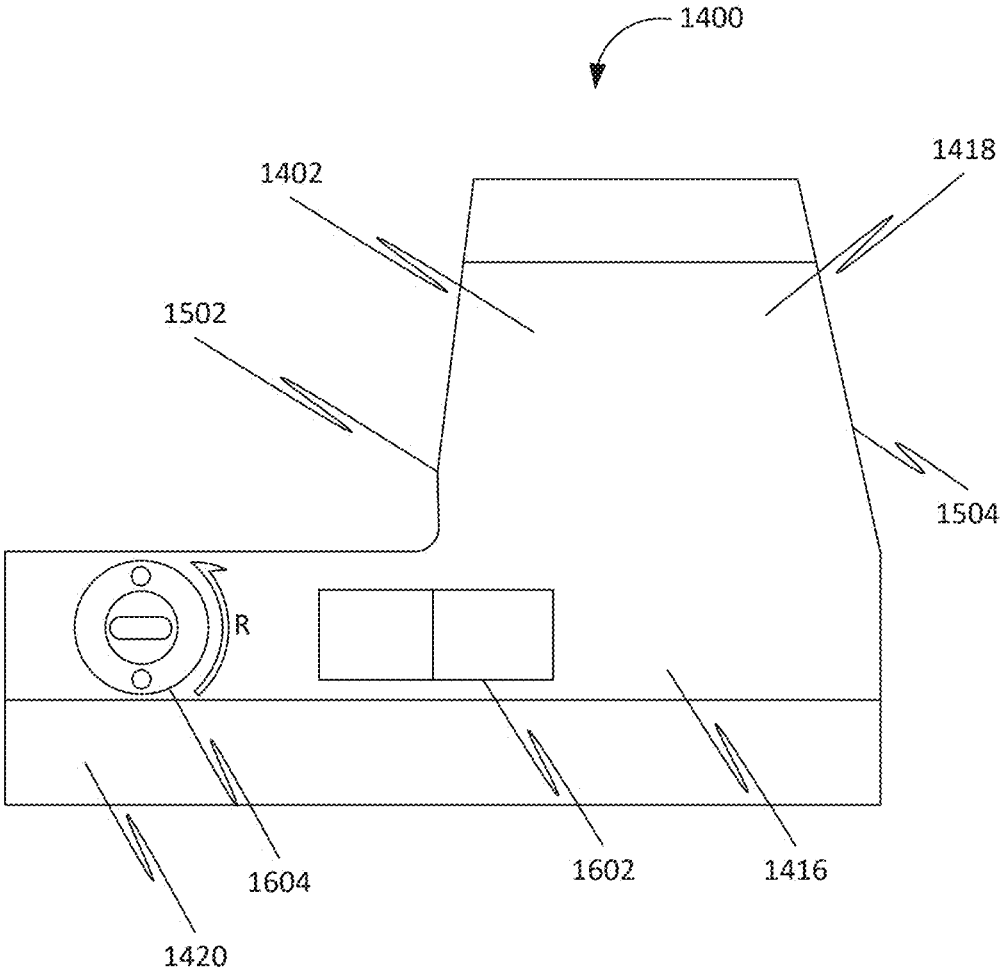
FIG. 16 is a left view of the sight apparatus 1400 for facilitating sighting, in accordance with some embodiments.

FIG. 16 is a left view of the sight apparatus 1400 for facilitating sighting, in accordance with some embodiments. Further, the sight apparatus 1400 may include a sliding infrared switch 1602 and an adjustment screw 1604. Further, the base portion 1416 may include at least one mounting element 1420 comprised in the base portion 1416.

Figure 17:
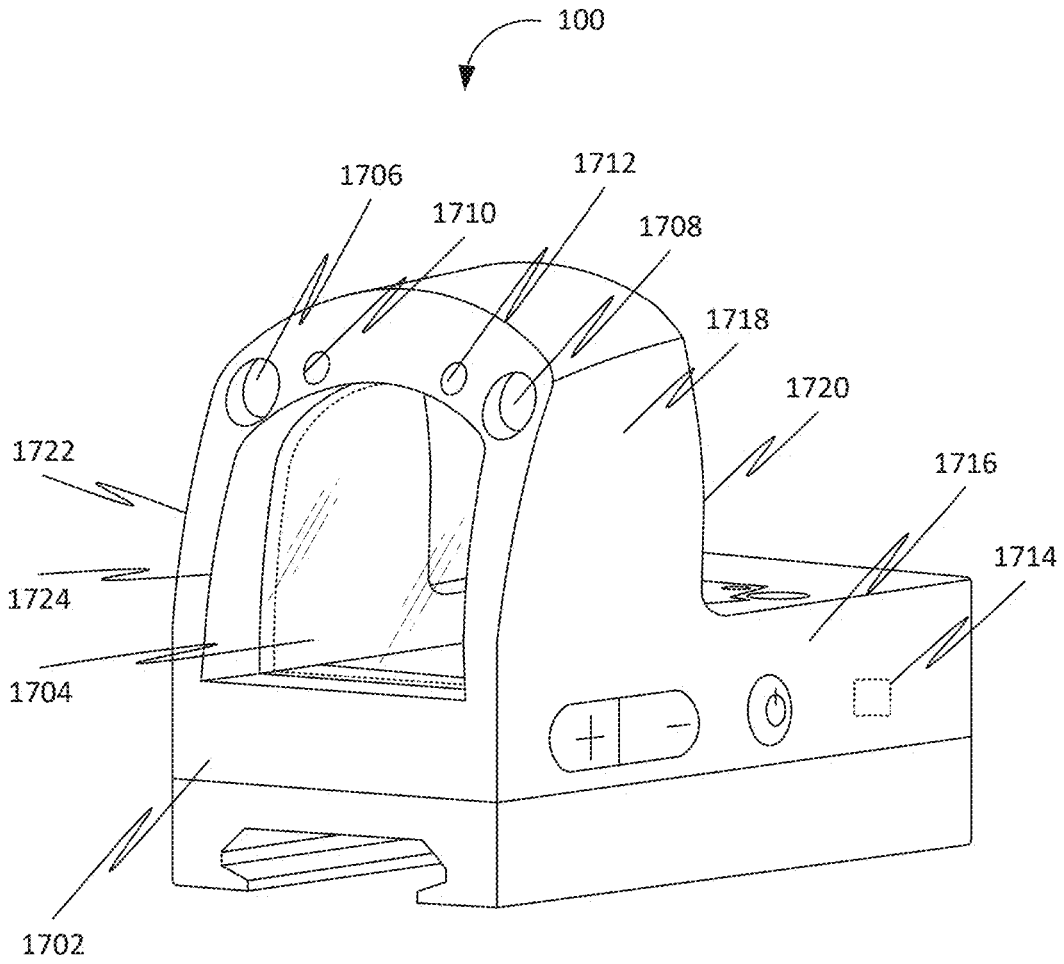
FIG. 17 is a perspective view of a sight apparatus 1700 for a device in accordance with some embodiments.

FIG. 17 is a perspective view of a sight apparatus 1700 for a device in accordance with some embodiments. Accordingly, the sight apparatus 1700 may include a body 1702, at least one optical element 1704, at least one lighting device 1706-1712, and at least one power source 1714.

Further, the body 1702 may include a base portion 1716 and a sight portion 1718. Further, the sight portion 1718 upwardly extends from the base portion 1716. Further, the sight portion 1718 may include a viewing end 1720 and a target end 1722. Further, the viewing end 1720 opposes the target end 1722. Further, the sight portion 1718 defines an opening 1724 between the viewing end 1720 and the target end 1722. Further, the base portion 1716 may be configured for mounting the sight apparatus. 1700 to at least one device.

Further, the at least one optical element 1704 may be comprised in the opening and supported by at least one of the sight portion 1718 and the base portion 1716. Further, the at least one optical element 1704 allows a user to view a target area from the viewing end 1720 of the sight portion 1718.

Further, the at least one lighting device 1706-1712 may be comprised in the target end 1722 of the sight portion 1718 around the opening. Further, the at least one lighting device 1706-1712 may be configured for emitting light with at least one characteristic for illuminating the target area. Further, the at least one lighting device 1706-1712 may include at least one primary lighting device 1706-1708 and at least one secondary lighting device 1710-1712. Further, the at least one characteristic may include at least one first characteristic and at least one second characteristic. Further, the at least one primary lighting device may be configured for emitting light of the at least one first characteristic. Further, the at least one secondary lighting device may be configured for emitting light with the at least one second characteristic. Further, the emitting of the light with the at least one characteristic may include the emitting of the light with the at least one first characteristic and the emitting of the light with the at least one second characteristic.

Further, the at least one power source 1714 may be comprised in the body 1702. Further, the at least one power source 1714 may be electrically coupled with the at least one lighting device 1706-1712. Further, the at least one power source 1714 may be configured for powering the at least one lighting device 1706-1712. Further, the emitting of the light may be based on the powering.

Figure 18:
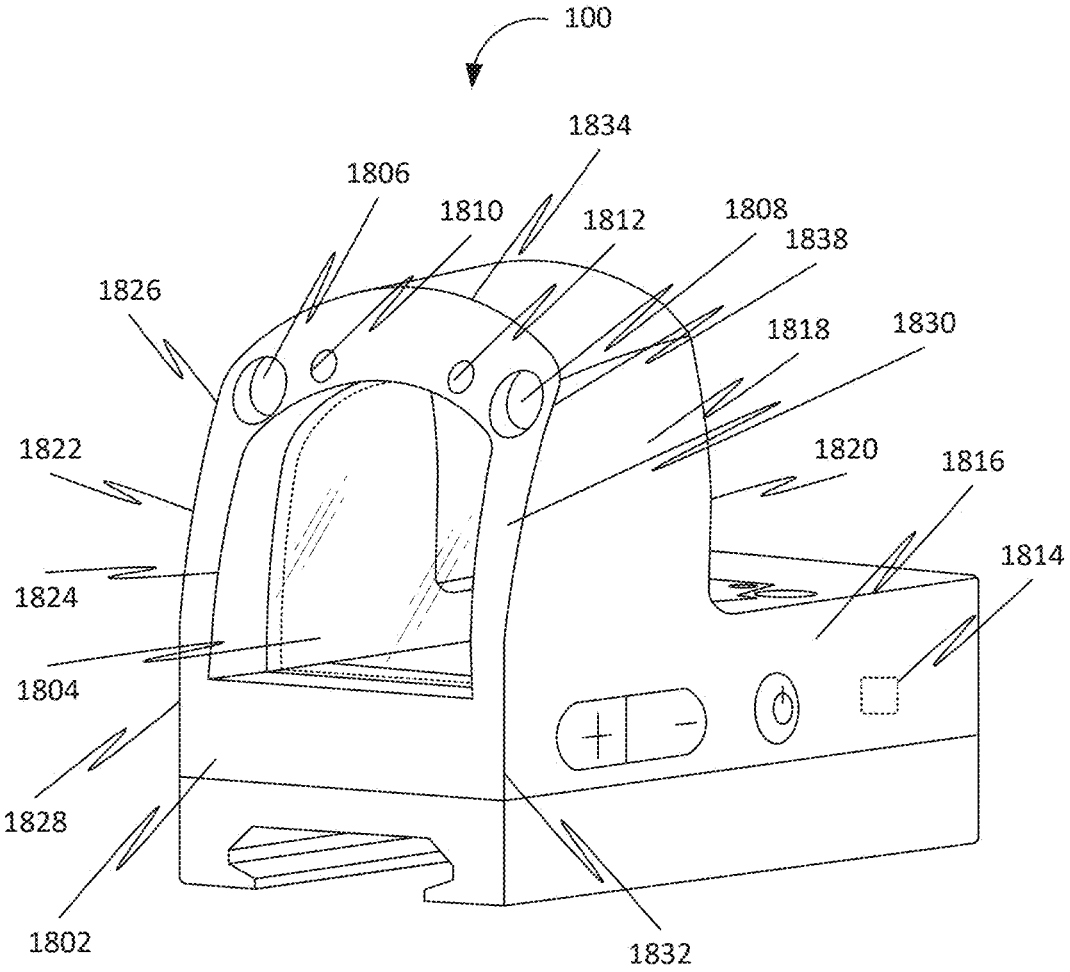
FIG. 18 is a perspective view of a sight apparatus 1800 for a device in accordance with some embodiments.

FIG. 18 is a perspective view of a sight apparatus 1800 for a device in accordance with some embodiments. Accordingly, the sight apparatus 1800 may include a body 1802, at least one optical element 1804, at least one lighting device 1806-1812, and at least one power source 1814.

Further, the body 1802 may include a base portion 1816 and a sight portion 1818. Further, the sight portion 1818 upwardly extends from the base portion 1816. Further, the sight portion 1818 may include a viewing end 1820 and a target end 1822. Further, the viewing end 1820 opposes the target end 1822. Further, the sight portion 1818 defines an opening 1824 between the viewing end 1820 and the target end 1822. Further, the base portion 1816 may be configured for mounting the sight apparatus 1800 to at least one device. Further, the sight portion 1818 may include a first vertical support 1826 extending from a first side 1828 of the base portion 1816, a second vertical support 1830 extending from a second side 1832 of the base portion 1816, a horizontal support 1834 extending from a first top end 1836 of the first vertical support 1826 to a second top end 1838 of the second vertical support 1830. Further, the first side 1828 opposes the second side 1832.

Further, the at least one optical element 1804 may be comprised in the opening 1824 and supported by at least one of the sight portion 1818 and the base portion 1816. Further, the first vertical support 1826, the second vertical support 1830, and the horizontal support 1834 extend in at least a part around the at least one optical element 1804 for supporting the at least one optical element 1804. Further, the at least one optical element 1804 allows a user to view a target area from the viewing end 1820 of the sight portion 1818.

Further, the at least one lighting device 1806-1812 may be comprised in the target end 1822 of the sight portion 1818 around the opening 1824. Further, the at least one lighting device 1806-1812 may be configured for emitting light with at least one characteristic for illuminating the target area. Further, the at least one lighting device 1806-1812 may be further comprised in the horizontal support 1834 of the sight portion 1818. Further, the at least one lighting device

1806-1812 may include a number of lighting devices. Further, the number of lighting devices ranges from 1 to 4.

Further, the at least one power source 1814 may be comprised in the body 1802. Further, the at least one power source 1814 may be electrically coupled with the at least one lighting device 1806-1812. Further, the at least one power source 1814 may be configured for powering the at least one lighting device 1806-1812. Further, the emitting of the light may be based on the powering.

Figure 19:
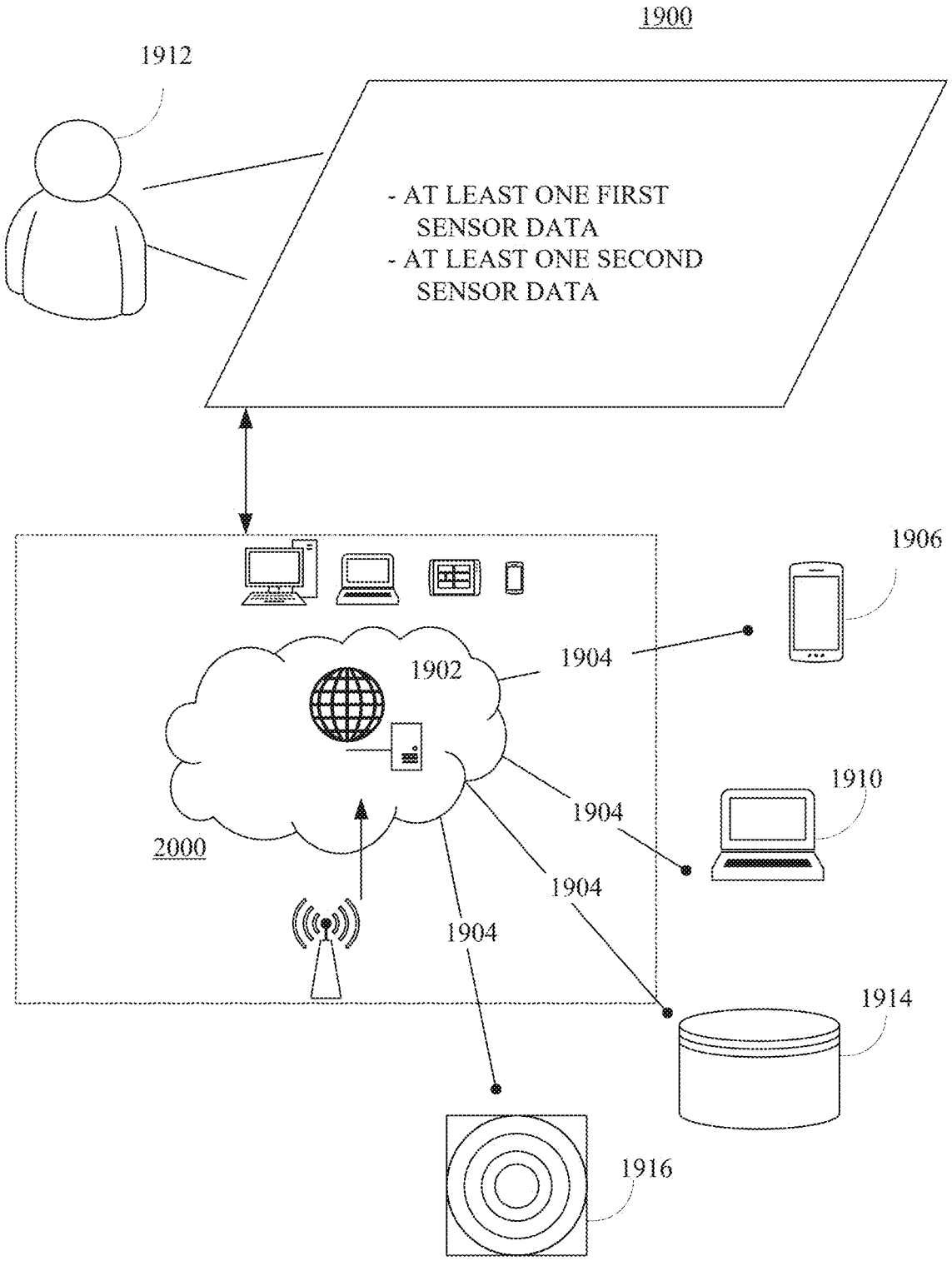
FIG. 19 is an illustration of an online platform consistent with various embodiments of the present disclosure.

FIG. 19 is an illustration of an online platform 1900 consistent with various embodiments of the present disclosure. By way of non-limiting example, the online platform 1900 to facilitate sighting for a device may be hosted on a centralized server 1902, such as, for example, a cloud computing service. The centralized server 1902 may communicate with other network entities, such as, for example, a mobile device 1906 (such as a smartphone, a laptop, a tablet computer, etc.), other electronic devices 1910 (such as desktop computers, server computers, etc.), databases 1914, and sensors 1916 over a communication network 1904, such as, but not limited to, the Internet. Further, users of the online platform 1900 may include relevant parties such as, but not limited to, end-users, administrators, service providers, service consumers, and so on. Accordingly, in some instances, electronic devices operated by the one or more relevant parties may be in communication with the platform.

A user 1912, such as the one or more relevant parties, may access online platform 1900 through a web based software application or browser. The web based software application may be embodied as, for example, but not be limited to, a website, a web application, a desktop application, and a mobile application compatible with a computing device 2000.

Figure 20:
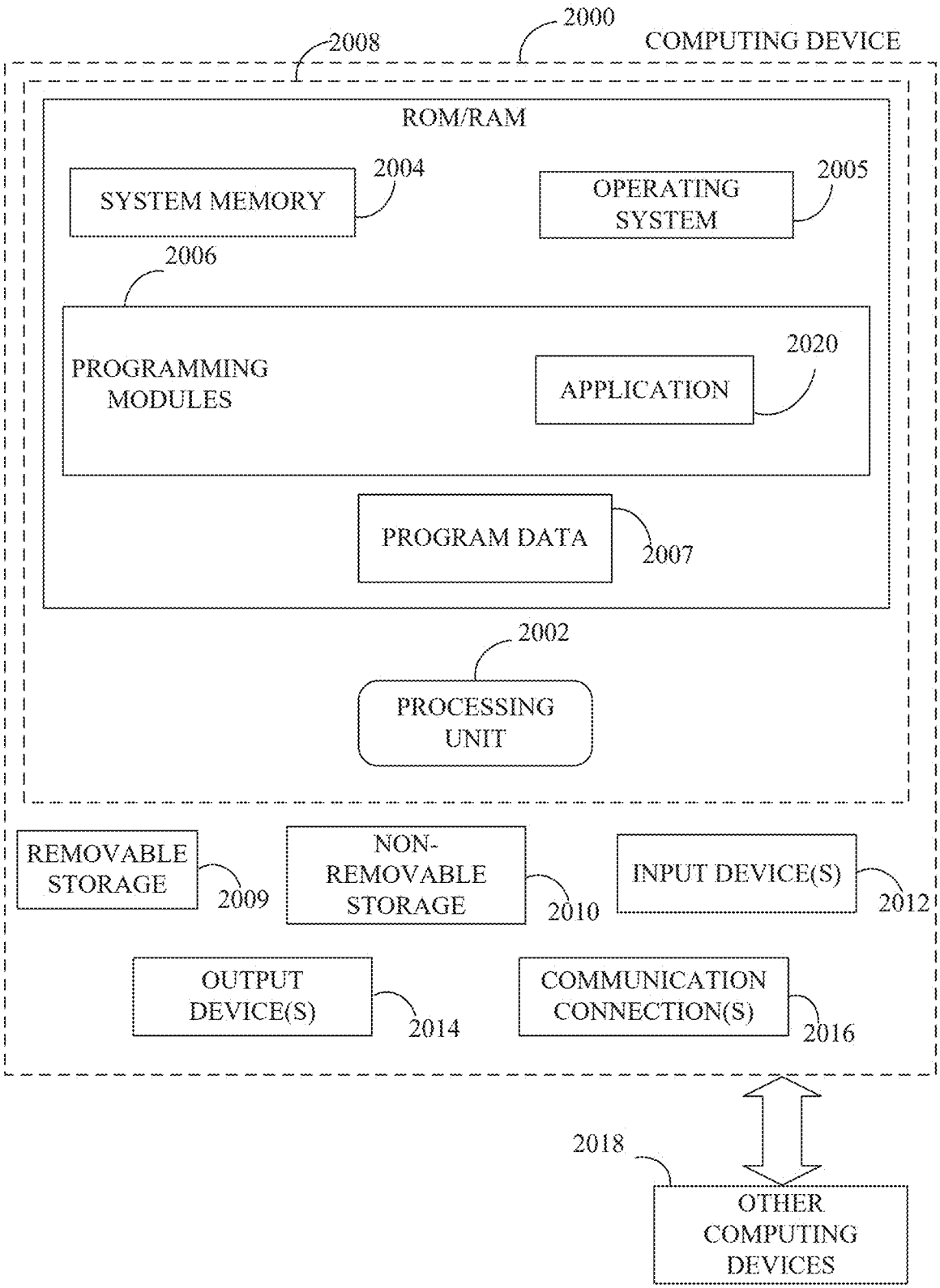
FIG. 20 is a block diagram of a computing device for implementing the methods disclosed herein, in accordance with some embodiments.

With reference to FIG. 20, a system consistent with an embodiment of the disclosure may include a computing device or cloud service, such as computing device 2000. In a basic configuration, computing device 2000 may include at least one processing unit 2002 and a system memory 2004. Depending on the configuration and type of computing device, system memory 2004 may comprise, but is not limited to, volatile (e.g. random-access memory (RAM)), non-volatile (e.g. read-only memory (ROM)), flash memory, or any combination. System memory 2004 may include operating system 2005, one or more programming modules 2006, and may include a program data 2007. Operating system 2005, for example, may be suitable for controlling computing device 2000's operation. In one embodiment, programming modules 2006 may include image-processing modules, machine learning modules, etc. Furthermore, embodiments of the disclosure may be practiced in conjunction with a graphics library, other operating systems, or any other application program and is not limited to any particular application or system. This basic configuration is illustrated in FIG. 20 by those components within a dashed line 2008.

Computing device 2000 may have additional features or functionality. For example, computing device 2000 may also include additional data storage devices (removable and/or non-removable) such as, for example, magnetic disks, optical disks, or tape. Such additional storage is illustrated in FIG. 20 by a removable storage 2009 and a non-removable storage 2010. Computer storage media may include volatile and non-volatile, removable, and non-removable media implemented in any method or technology for storage of information, such as computer-readable instructions, data structures, program modules, or other data. System memory 2004, removable storage 2009, and non-removable storage 2010 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD), other optical storage, magnetic cassettes, magnetic tape, magnetic disk storage or other magnetic storage devices, or any other medium which can be used to store information and which can be accessed by computing device 2000. Any such computer storage media may be part of device 2000. Computing device 2000 may also have input device(s) 2012 such as a keyboard, a mouse, a pen, a sound input device, a touch input device, a location sensor, a camera, a biometric sensor, etc. Output device(s) 2014 such as a display, speakers, a printer, etc. may also be included. The aforementioned devices are examples and others may be used.

Computing device 2000 may also contain a communication connection 2016 that may allow device 2000 to communicate with other computing devices 2018, such as over a network in a distributed computing environment, for example, an intranet or the Internet. Communication connection 2016 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 2004, including operating system 2005. While executing on processing unit 2002, programming modules 2006 (e.g., application 2020 such as a media player) may perform processes including, for example, one or more stages of methods, algorithms, systems, applications, servers, databases as described above. The aforementioned process is an example, and processing unit 2002 may perform other processes. Other programming modules that may be used in accordance with embodiments of the present disclosure may include machine learning applications.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, general purpose graphics processor-based systems, multiprocessor systems, microprocessor-based or programmable consumer electronics, application specific integrated circuit-based electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

Although the present disclosure has been explained in relation to its preferred embodiment, it is to be understood that many other possible modifications and variations can be made without departing from the spirit and scope of the disclosure.

What is claimed is:

1. A sight apparatus for a device, the sight apparatus comprising:

a body comprising a base portion and a sight portion, wherein the sight portion upwardly extends from the base portion, wherein the sight portion comprises a viewing end and a target end, wherein the viewing end opposes the target end, wherein the sight portion defines an opening between the viewing end and the target end, wherein the base portion is configured for mounting the sight apparatus to at least one device;

at least one optical element comprised in the opening and supported by at least one of the sight portion and the base portion, wherein the at least one optical element allows a user to view a target area from the viewing end of the sight portion;

at least one lighting device comprised in the target end of the sight portion around the opening, wherein the at least one lighting device is configured for emitting light with at least one characteristic for illuminating the target area;

at least one power source comprised in the body, wherein the at least one power source is electrically coupled with the at least one lighting device, wherein the at least one power source is configured for powering the at least one lighting device, wherein the emitting of the light is based on the powering;

wherein the sight portion comprises a first vertical support extending from a first side of the base portion, a second vertical support extending from a second side of the base portion, a horizontal support extending from a first top end of the first vertical support to a second top end of the second vertical support, wherein the first side opposes the second side, wherein the first vertical support, the second vertical support, and the horizontal support extend in at least a part around the at least one optical element for supporting the at least one optical element;

wherein the at least one lighting device is further comprised in the horizontal support of the sight portion;

at least one first sensor configured for detecting at least one environmental condition of an environment associated with the sight apparatus;

a processing device communicatively coupled with the at least one first sensor, wherein the processing device is configured for:

generating at least one environmental data based on the detecting of the at least one environmental condition;

analyzing the at least one environmental data;

determining at least one required characteristic of the light required to be emitted by the at least one lighting device; and generating at least one command based on the determining of the at least one required characteristic of the light.

2. The sight apparatus of claim 1, wherein the at least one lighting device comprises at least one primary lighting device and at least one secondary lighting device, wherein the at least one characteristic comprises at least one first characteristic and at least one second characteristic, wherein the at least one primary lighting device is configured for emitting light of the at least one first characteristic, wherein the at least one secondary lighting device is configured for emitting light with the at least one second characteristic, wherein the emitting of the light with the at least one characteristic comprises the emitting of the light with the at least one first characteristic and the emitting of the light with the at least one second characteristic.

3. The sight apparatus of claim 2, wherein the at least one first characteristic comprises a first wavelength of the light emitted by the at least one primary lighting device, wherein the at least one second characteristic comprises a second wavelength of the light emitting by the at least one secondary lighting device, wherein the first wavelength of the light is within a visible portion of electromagnetic radiation, wherein the second wavelength is within an infrared portion of the electromagnetic radiation.

4. The sight apparatus of claim 1, wherein the base portion of the body is configured to be dismountably mounted from the at least one device.

5. The sight apparatus of claim 1, wherein the base portion of the body comprises a front base portion and a rear base portion, wherein the sight portion extends from the front base portion, wherein the rear base portion comprises a receptacle comprised in a center of the rear base portion, wherein the sight apparatus further comprises an additional lighting device comprised in the receptacle of the rear base portion, wherein the additional lighting device is configured for projecting a reticle onto the at least one optical element, wherein the reticle is configured for aiming in the target area, wherein the at least one power source is electrically coupled with the additional lighting device, wherein the at least one power source is configured for powering the additional lighting device, wherein the projecting of the reticle is based on the powering.

6. The sight apparatus of claim 5, wherein the at least one optical element comprises at least one layer of at least one material on at least one surface of the at least one optical element, wherein the at least one layer of the at least one material allows the projecting of the reticle on the at least one optical element.

7. The sight apparatus of claim 1, wherein the at least one lighting device comprises a number of lighting devices.

8. The sight apparatus of claim 1, wherein the at least one characteristic of the light comprises an intensity of the light, wherein the sight apparatus comprises at least one first input device electrically coupled with the at least one lighting device and the at least one power source, wherein the at least one lighting device is electrically coupled with the at least one power source through the at least one first input device, wherein the at least one first input device is configured for receiving at least one input, wherein the at least one first input device is configured to be transitioned between a plurality of states based on the at least one input, wherein the intensity of the light emitted by the at least one lighting device transitions between a plurality of levels of the intensity of the light based on the transitioning of the at least one first input device between the plurality of states.

9. The sight apparatus of claim 8 further comprising at least one second input device electrically coupled with the at least one lighting device and the at least one power source, wherein the at least one lighting device is electrically coupled with the at least one power source through the at least one second input device, wherein the at least one second input device is configured for receiving at least one second input, wherein the at least one second input device is configured to be transitioned between at least one first state and at least one second state based on the at least one second input, wherein the transitioning of the at least one second input device transitions the at least one lighting device between an on state and an off state, wherein the emitting of the light with the at least one characteristic is based on the on state of the at least one lighting device, wherein the at least one lighting device does not emit light in the off state of the at least one lighting device.

10. The sight apparatus of claim 1, further comprising a lighting control device communicatively coupled with the processing device, wherein the at least one lighting device is electrically coupled to the at least one power source through the lighting control device, wherein the lighting control device is configured for configuring the at least one lighting device, wherein the emitting of the light with the at least one characteristic comprises emitting of the light with the at least one required light characteristic based on the configuring.

11. The sight apparatus of claim 10, wherein the at least one lighting device comprises a plurality of lighting devices, wherein the processing device is configured for:

selecting the at least one lighting device from the plurality of lighting devices based on the analyzing of the at least one environmental data; and generating at least one first command for the at least one lighting device based on the determining of the selection of the at least one lighting device, wherein the lighting control device is further configured for activating the at least one lighting device based on the at least one first command, wherein the emitting of the light with the at least one required characteristic by the at least one lighting device is further based on the activating of the at least one lighting device.

12. The sight apparatus of claim 1 further comprising at least one adjustment mechanism comprised in the body, wherein the at least one adjustment mechanism is configured for adjusting at least one alignment of the sight apparatus in relation to the at least one device based on at least one adjustment input receivable by the at least one adjustment mechanism.

13. The sight apparatus of claim 10, wherein the sight portion comprises at least one mechanism comprised in the sight portion, wherein the at least one mechanism is coupled with the at least one lighting device, wherein the at least one mechanism is configured for configured for modifying at least one of a position and an orientation of the at least one lighting device in relation to the target end of the sight portion.

14. The sight apparatus of claim 13 further comprising:

at least one second sensor configured for detecting the at least one environmental condition of an environment associated with the sight apparatus;

a processing device communicatively coupled with the at least one second sensor, wherein the processing device is configured for:

generating at least one environmental data based on the detecting of the at least one environmental condition;

analyzing the at least one environmental data;

determining a required illumination field for the sight apparatus based on the analyzing of the at least one environmental data;

determining at least one of a required position and a required orientation of the at least one lighting device based on the determining of the required illumination field; and generating at least one second command for the emitting of the light by the at least one lighting device with the required illumination field; and at least one actuator communicatively coupled with the processing device, wherein the at least one actuator is operatively coupled with the at least one mechanism, wherein the at least one actuator is configured for transitioning the at least one mechanism to at least one state based on the at least one second command, wherein the transitioning of the at least one mechanism to the at least one state modifies at least one of the position and the orientation of the at least one lighting device to at least one of the required position and the orientation.

15. The sight apparatus of claim 1, wherein the base portion comprises at least one mounting element comprised in the base portion, wherein the at least one mounting element is configured to be engaged with at least one portion of the at least one device, wherein the mounting of the sight apparatus to the at least one device is further based on the engaging of the at least one mounting element to the at least one portion of the at least one device.

16. The sight apparatus of claim 1, wherein the at least one device comprises a firearm, wherein the mounting of the sight apparatus to the at least one device comprises mounting the sight apparatus to the firearm.

17. A sight apparatus for a device, the sight apparatus comprising:

a body comprising a base portion and a sight portion, wherein the sight portion upwardly extends from the base portion, wherein the sight portion comprises a viewing end and a target end, wherein the viewing end opposes the target end, wherein the sight portion defines an opening between the viewing end and the target end, wherein the base portion is configured for mounting the sight apparatus to at least one device;

at least one optical element comprised in the opening and supported by at least one of the sight portion and the base portion, wherein the at least one optical element allows a user to view a target area from the viewing end of the sight portion;

at least one lighting device comprised in the target end of the sight portion around the opening, wherein the at least one lighting device is configured for emitting light with at least one characteristic for illuminating the target area, wherein the at least one lighting device comprises at least one primary lighting device and at least one secondary lighting device, wherein the at least one characteristic comprises at least one first characteristic and at least one second characteristic, wherein the at least one primary lighting device is configured for emitting light of the at least one first characteristic, wherein the at least one secondary lighting device is configured for emitting light with the at least one second characteristic, wherein the emitting of the light with the at least one characteristic comprises the emitting of the light with the at least one first characteristic and the emitting of the light with the at least one second characteristic;

at least one power source comprised in the body, wherein the at least one power source is electrically coupled with the at least one lighting device, wherein the at least one power source is configured for powering the at least one lighting device, wherein the emitting of the light is based on the powering; and wherein the sight portion comprises a first vertical support extending from a first side of the base portion, a second vertical support extending from a second side of the base portion, a horizontal support extending from a first top end of the first vertical support to a second top end of the second vertical support, wherein the first side opposes the second side, wherein the first vertical support, the second vertical support, and the horizontal support extend in at least a part around the at least one optical element for supporting the at least one optical element;

wherein the at least one lighting device is further comprised in the horizontal support of the sight portion;

at least one first sensor configured for detecting at least one environmental condition of an environment associated with the sight apparatus;

a processing device communicatively coupled with the at least one first sensor, wherein the processing device is configured for:

generating at least one environmental data based on the detecting of the at least one environmental condition;

analyzing the at least one environmental data;

determining at least one required characteristic of the light required to be emitted by the at least one lighting device; and generating at least one command based on the determining of the at least one required characteristic of the light.

18. A sight apparatus for a device, the sight apparatus comprising:

a body comprising a base portion and a sight portion, wherein the sight portion upwardly extends from the base portion, wherein the sight portion comprises a viewing end and a target end, wherein the viewing end opposes the target end, wherein the sight portion defines an opening between the viewing end and the target end, wherein the base portion is configured for mounting the sight apparatus to at least one device, wherein the sight portion comprises a first vertical support extending from a first side of the base portion, a second vertical support extending from a second side of the base portion, a horizontal support extending from a first top end of the first vertical support to a second top end of the second vertical support, wherein the first side opposes the second side;

at least one optical element comprised in the opening and supported by at least one of the sight portion and the base portion, wherein the first vertical support, the second vertical support, and the horizontal support extend in at least a part around the at least one optical element for supporting the at least one optical element, wherein the at least one optical element allows a user to view a target area from the viewing end of the sight portion;

at least one lighting device comprised in the target end of the sight portion around the opening, wherein the at least one lighting device is configured for emitting light with at least one characteristic for illuminating the target area, wherein the at least one lighting device is further comprised in the horizontal support of the sight portion, wherein the at least one lighting device comprises a number of lighting devices; and at least one power source comprised in the body, wherein the at least one power source is electrically coupled with the at least one lighting device, wherein the at least one power source is configured for powering the at least one lighting device, wherein the emitting of the light is based on the powering; and at least one first sensor configured for detecting at least one environmental condition of an environment associated with the sight apparatus;

a processing device communicatively coupled with the at least one first sensor, wherein the processing device is configured for:

generating at least one environmental data based on the detecting of the at least one environmental condition;

analyzing the at least one environmental data;

determining at least one required characteristic of the light required to be emitted by the at least one lighting device; and generating at least one command based on the determining of the at least one required characteristic of the light.

* * * * *